US005766832A

United States Patent [19]

Nishio

[11] Patent Number: 5,766,832

[45] **Date of Patent: *Jun. 16, 1998**

[54] SOLID DEVELOPER-REPLENISHING COMPOSITION FOR PROCESSING SILVER HALIDE PHOTOGRAPHIC LIGHT SENSITIVE MATERIAL

[75] Inventor: Shoji Nishio, Hino, Japan

[73] Assignee: Konica Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 717,342

[22] Filed: Sep. 20, 1996

[30] Foreign Application Priority Data

Sep. 28, 1995 [JP] Japan ..... 7-251168

[51] Int. Cl.[6] ..... G03C 5/30

[52] U.S. Cl. ..... 430/465; 430/440; 430/446; 430/480; 430/483

[58] Field of Search ..... 430/440, 446, 430/465, 480, 483

[56] References Cited

U.S. PATENT DOCUMENTS

| | | | |
|---|---|---|---|
| 2,688,549 | 9/1954 | James et al. | 430/483 |
| 4,816,384 | 3/1989 | Fruge et al. | 430/435 |
| 5,098,819 | 3/1992 | Knapp | 430/440 |
| 5,135,840 | 8/1992 | Reuter et al. | 430/465 |
| 5,196,298 | 3/1993 | Meens et al. | 430/440 |
| 5,236,816 | 8/1993 | Purol et al. | 430/440 |
| 5,258,268 | 11/1993 | Reuter et al. | 430/465 |
| 5,376,509 | 12/1994 | Yoshimoto et al. | 430/465 |
| 5,384,232 | 1/1995 | Bishop et al. | 430/446 |
| 5,434,292 | 7/1995 | Saito et al. | 560/51 |
| 5,474,879 | 12/1995 | Fitterman et al. | 430/440 |
| 5,503,965 | 4/1996 | Okutsu | 430/440 |

FOREIGN PATENT DOCUMENTS

| | | |
|---|---|---|
| 0 545 645 A1 | 6/1993 | European Pat. Off. . |
| 0 573 700 A1 | 12/1993 | European Pat. Off. . |

*Primary Examiner*—Hoa Van Le

*Attorney, Agent, or Firm*—Frishauf, Holtz, Goodman, Langer & Chick, P.C.

[57] ABSTRACT

A solid processing composition in the form of granules or a tablet for use as a replenisher of a developer for processing a silver halide black-and-white photographic light sensitive material is disclosed, wherein the solid processing composition is substantially free from a dihydroxybenzene as a developing agent and comprises a cyclodextrin compound.

9 Claims, No Drawings

SOLID DEVELOPER-REPLENISHING COMPOSITION FOR PROCESSING SILVER HALIDE PHOTOGRAPHIC LIGHT SENSITIVE MATERIAL

FIELD OF THE INVENTION

The present invention relates to a solid developer replenishing composition for processing a silver halide photographic light sensitive material, and particularly to a solid developer replenishing composition, enhancing running-process stability in processing with a developer containing substantially no dihydroxybenzene and a processing method by use thereof.

BACKGROUND OF THE INVENTION

Processing of silver halide photographic light sensitive materials is accomplished mainly with an automatic processor, due to stability, easiness, speed and handlability. Dihydroxybenzenes (mainly, hydroquinone) are used as a developing agent in almost all developers and replenishers thereof for processing a silver halide black-and-white photographic light sensitive material. However, the use thereof resulted in problems such as the developer blackening due to aerial oxidation and hydroquinone polymer produced as a by-product was adhered to the conveying rollers in the processor or to a processed photographic material, leading to deterioration in quality of the finished photographs.

A means for solving these problems is replacement of hydroquinone as a developing agent by ascorbic acid, as disclosed in U.S. Pat. No. 5,236,816 and WO 93/11456. However, processing by using these developers with replenishing, over a long period of time resulted in marked lowering of activity of the developer and process stability was insufficient, leading to desire for an improvement thereof.

Addition of a cyclodextrin compound to a developer for a silver halide black-and-white photographic material containing dihyroxybenzenes is disclosed in unexamined published Japanese Patent Application publication (hereinafter, denoted as JP-A) 6-118579, 6-35133, 5-265150 and 6-75321. However, addition of cyclodextrin to a developer containing ascorbic acid did not lead to the desired improvement in running-process stability.

SUMMARY OF THE INVENTION

An objective of the present invention is improvement in stability in running-process with a developer using ascorbic acid or its derivatives.

The objective of the present invention as described above is accomplished by the following.

(1) A solid composition in the form of granules or a tablet for use as a developer replenishing composition for processing a silver halide photographic light sensitive material, wherein said solid composition is substantially free from a dihydroxybenzene as a developing agent and comprises a cyclodextrin compound.

(2) The solid developer replenishing composition for processing the silver halide photographic material as described in (1), wherein said solid composition comprises a azole compound as a restrainer.

(3) The solid developer replenishing composition for processing the silver halide photographic material as described in (1) or (2), wherein said solid composition comprises a compound represented by the following formula.

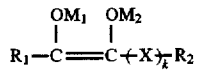

Formula (1)

In the formula, $R_1$ and $R_2$ independently are a substituted or unsubstituted alkyl group, substituted or unsubstituted amino group, substituted or unsubstituted alkoxy group or substituted or unsubstituted alkylthio group, and $R_1$ and $R_2$ may combine with each other to form a ring; k is 0 or 1, and when k is 1, X is —CO— or —CS—; $M_1$ and $M_2$ each are a hydrogen atom or alkali metal.

(4) The solid developer replenishing composition for processing the silver halide photographic material as described in (1), (2) or (3), wherein said photographic material comprises a hydrazine compound.

(5) The solid developer replenishing composition for processing the silver halide photographic material as described in (1), (2) or (3), wherein said photographic material comprises a tetrazolium compound.

(6) The solid developer replenishing composition for processing the silver halide photographic material as described in (1), (2) or (3), wherein said photographic material comprises a pyridinium compound.

(7) A method for processing a silver halide photographic material, wherein a photographic material comprising a hydrazine compound is processed using the solid developer replenishing composition as described in (1), (2) or (3).

(8) A method for processing a silver halide photographic material, wherein a photographic material comprising a tetrazolium compound is processed using the solid developer replenishing composition as described in (1), (2) or (3).

(9) A method for processing a silver halide photographic material, wherein a photographic material comprising a pyridinium compound is processed using the solid developer replenishing composition as described in (1), (2) or (3).

Thus present invention was based on the inventor's finding that, when processed by use of an ascorbic acid type compound as a developing agent, improved stability in running-process was achieved by using a developer-replenishing composition in the form of granules or a tablet and a replenishing solution containing a cyclodextrin compound with a restraining agent.

DETAILED DESCRIPTION OF THE INVENTION

The developer replenishing composition of the invention contains substantially no dihydroxybenzene and comprised a compound represented by the formula (1) afore-described. In the formula (1), a compound formed by combination of $R_1$ and $R_2$ and represented by the following formula (1-a) is preferred.

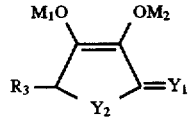

Formula (1-a)

In formula (1-a), $R_3$ is a hydrogen atom, substituted or unsubstituted alkyl group, substituted of unsubstituted aryl group, substituted or unsubstituted amino group, substituted or unsubstituted alkoxy group, sulfo group, carboxy group, amido group or sulfonamido group; $Y_1$ is O or S; $Y_2$ iso, S or $NR_4$, in which $R_4$ is substituted or unsubstituted alkyl group or substituted or unsubstituted aryl group; and $m_1$ and $M_2$ each are a hydrogen atom or alkali metal atom.

As the alkyl group of formula (1) and formula (1-a) is preferred a lower alkyl group, such as-an alkyl group having 1 to 5 carbon atoms; the amino group is preferably unsubstituted amino group or amino group substituted by a lower alkoxy group; the alkoxy group is preferably a lower alkoxy group; the aryl group is preferably a phenyl group or naphthyl group; these groups may be substituted and as substituents are cited hydroxy group, halogen atom, alkoxy group, sulfo group, carboxy group, amido group, and sulfonamido group. $M_1$ and $M_2$ each are a hydrogen atom or alkali metal atom, preferably sodium or potassium atom.

Examples of the compound represented by formulas (1) and (1-a) are shown below, but the present invention is not limited thereto.

| No. | X | $R_1$ | $R_2$ | $M_1$ | $M_2$ |
|---|---|---|---|---|---|
| A-1 | —(k = 0) | $HOCH_2-CH(OH)-CH(OH)-$ | —OH | H | H |
| A-2 | —(k = 0) | $CH_3-CH(OH)-CH(OH)-$ | —OH | H | H |
| A-3 | —(k = 0) | $HOCH_2-CH(OH)-CH(OH)-$ | $-CH_3$ | H | H |
| A-4 | —(k = 0) | $CH_3-CH(OH)-CH(OH)-$ | $-CH_3$ | H | H |
| A-5 | $-C(=O)-$ (k = 1) | $HOCH_2-CH(OH)-CH(OH)-$ | —OH | H | H |
| A-6 | $-C(=O)-$ (k = 1) | $CH_3-CH(OH)-CH(OH)-$ | —OH | H | H |
| A-7 | $-C(=S)-$ (k = 1) | $HOCH_2-CH(OH)-CH(OH)-$ | —OH | H | H |
| A-8 | $-C(=S)-$ (k = 1) | $CH_3-CH(OH)-CH(OH)-$ | —OH | H | H |
| A-9 | $-C(=O)-$ (k = 1) | $HO-CH_2-$ | —OH | Na | H |
| A-10 | $-C(=O)-$ (k = 1) | $HO-CH_2-$ | $-CH_3$ | H | H |
| A-11 | $-C(=O)-$ (k = 1) | $HO-CH_2-$ | $-C_2H_5$ | H | H |
| A-12 | $-C(=O)-$ (k = 1) | $HO-CH_2-$ | $-C_2H_4OH$ | H | Na |

| No. | $Y_1$ | $Y_2$ | $R_3$ | $M_1$ | $M_2$ |
|---|---|---|---|---|---|
| A-13 | O | O | H | H | H |
| A-14 | O | O | $CH_3$ | H | H |
| A-15 | O | O | $CH_2(OH)$ | H | H |
| A-16 | O | O | $CH_3-CH(OH)-$ | H | H |
| A-17 | O | O | $HOCH_2-CH(OH)-$ | H | H |

-continued

| | | | | | |
|---|---|---|---|---|---|
| A-18 | O | O | $HOCH_2-CH(OH)-$ | Na | H |
| A-19 | O | O | $HOOCCH_2-CH(OH)-$ | H | Na |
| A-20 | S | O | H | Na | H |
| A-21 | S | O | $CH_3-CH(OH)-$ | H | H |
| A-22 | S | O | $HOCH_2-CH(OH)-$ | H | H |
| A-23 | O | $NCH_2$ | H | H | H |
| A-24 | O | NH | $HOCH_2-CH(OH)-$ | H | K |
| A-25 | O | S | H | H | H |
| A-26 | O | S | $HOCH_2-CH(OH)-$ | H | H |
| A-27 | O | S | $CH_3CH(OH)-$ | H | H |
| A-28 | S | S | H | H | H |
| A-29 | S | S | $HOCH_2-CH(OH)-$ | H | H |
| A-30 | S | S | H | H | H |

These compounds are exemplarily ascorbic acid, erythorbic acid or salts thereof (e.g., sodium, potassium, or lithium salt), derivatives derived therefrom, being commercially available and readily synthesized by a well known method.

The amount of the compound represented formula (1) or (1-a) used in a developer replenishing solution is 0.2 to 0.4 mol/l, preferably 0.15 to 0.25 mol/l.

As an auxiliary developing agent exhibiting supper additivity with the developing agent of the invention, i.e., the compound represented by formula (1) or (1-a) is cited a 3-pyrazolidone derivative or p-aminophenol derivative. Exemplary compounds are shown below, but the invention is not limited these compounds.

1-Phenyl-3-pyrazolidone
1-Phenyl-4,4'-dimethyl-3-pyrazolidone
1-phenyl-4-methyl-4-hydroxymethyl-3-pyrazolidone
1-Phenyl-5-methyl-3-pyrazolidone
1-p-Aminophenyl-4,4'-dimethyl-3-pyrazolidone
1-p-Tolyl-4,4'-dimethyl-3-pyrazolidone
1-p-Tolyl-4-methyl-4-hydroxymethyl-3-pyrazolidone
N-methyl-p-aminophenol
N-(β-hydroxyethyl)-p-aminophenol
N-(4-hydroxyphenyl)glycine
2-Methyl-p-aminophenol
p-Benzylaminophenol The solid developer replenishing composition of the invention contains substantially no dihydroxybenzene developing agent. Herein, the dihydroxybenzene developing agent refers to the following compound represented by V-1, V-2 or V-3.

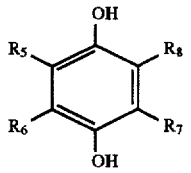

Formula V-1

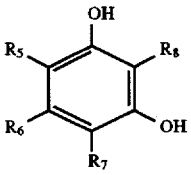

Formula V-2

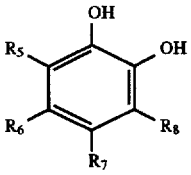

Formula V-3

In the formulas, $R_5$, $R_6$, $R_7$ and $R_8$ independently are a hydrogen atom, alkyl group, aryl group, carboxy group, halogen atom or sulfo group. Examples of the compounds include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Among these is popular hydroquinone.

The developer replenishing composition of the invention contains substantially no dihyroxybenzene compound. The word, "contains substantially no" refers to "does not contain in any amount" or "contain in a small amount that does not exhibit any allergic action or developing effect", and in the invention, it is preferred not to contain.

The cyclodextrin compound used in the invention will be explained. In the invention, the cyclodextrin compound includes a cyclodextrin, cyclodextrin derivative, branched cyclodextrin and cyclodextrin polymer.

The cyclodextrin of the invention is represented by formulas (2).

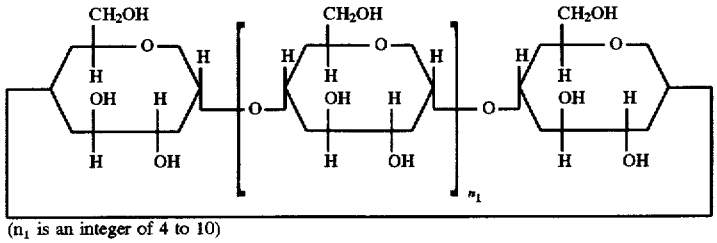

Formula (2)

($n_1$ is an integer of 4 to 10)

Among cyclodextrins represented by the above formula, α-cyclodextrin ($n_1$=4), β-cyclodextrin ($n_1$=5) and γ-cyclodextrin ($n_1$=6) are preferred.

Further, a cyclodextrin portion has a inclusion action and is capable of forming a inclusion compound Therefore, in the invention, the inclusion compound is also usable. The inclusion compound of cyclodextrin refers to a substance comprised of three-dimensional structure formed by bonding of atoms or molecules and having an internal space, in which other atoms or molecules are included in a composite ratio to form a specific crystal structure, described in F. Cramer, Einsthluse Verbundungen, Springer (1954) or M. Hagen, Clathrate Inclusion Conpounde, Reinheld (1962). Known derivatives in which a hydroxy group of the cyclodextrin is converted to a ether, ester or amino group. These cyclodextrin compounds are described in details in M. L. Bender and M. Komiyama, Cyclodextrin Chemistry, Springer-Verlag (1978).

The cyclodextrin derivative is represented by the following formula (3) or (4),

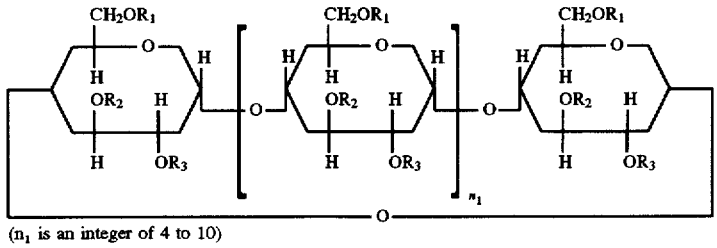

Formula (3)

($n_1$ is an integer of 4 to 10)

In formula (3), $R_1$, $R_2$ and $R_3$ independently are a hydrogen atom or substituted or unsubstituted alkyl group. $R_1$ and $R_3$ are preferably alkyl group. Examples of the compound represented by formula (3) are heptakis-2,6-dimethyl-β-cyclodextrin, hexakis-2,6-dimethyl-α-cyclodextrin, and octakis-2,6-dimethyl-γ-cyclodextrin.

$CD—(O—R)_m$ Formula (4)

In formula (4), CD is a cyclodextrin moiety, R is $R_2COOH$, $R_2SO_3$, $R_2NH_2$ or $R_2N(R_3)_2$, in which $R_2$ is a straight chained or branched alkylene group having 1 to 5 carbon atoms and $R_3$ is a straight chained or branched alkyl group having 1 to 5 carbon atoms; and m is an integer of 1 to 5.

Examples of the compound represented by formula (4) are shown below.

| | R | m |
|---|---|---|
| 4-1 | $—CH_2COOH$ | 3 |
| 4-2 | $—CH_2COOH$ | 5 |
| 4-3 | $—(CH_2)_4SO_3H$ | 1 |
| 4-4 | $—(CH_2)_4SO_3H$ | 3 |
| 4-5 | $—NCH_2CH_2(C_2H_5)_2$ | 2 |

Now, a branched cyclodextrin will be explained. The branched cyclodextrin is a compound in which a water soluble substance such as monosaccharide or disaccharide including glucose, maltose, cellobiose, lactose, saccharose, galactose, glucosamine is added or attached to a cyclodextrin known in the art. Preferably, are cited maltosylcyclodextrin in which maltose is attached to cyclodextrin (the number of maltose attached to cyclodextrin may be any of one, two or three molecules) and glucosyldextrin in which glucose is attached to cyclodextrin (the number of glucose attached to cyclodextrin may be any of one, two or three molecules).

The branched cyclodextrin can be synthesized according to methods described in Denpun Kagaku (Starch Chemistry) 33 (2) 119–126 (1986); ibid 33 (2) 127–132 (1986); ibid 30 (2) 231–239 (1983). Maltosylcyclodextrin, for example, can be prepared in such a manner that cyclodextrin and maltose are used as starting materials and maltose is bonded to cyclodextrin by means of enzyme such as isoamirase or pulluranase. Glucosylcyclodextrin can be prepared in a similar manner.

As preferable branched cyclodextrins, the following exemplary compounds are cited below.

Exemplified compound:

D-1; α-cyclodextrin with one attached maltose molecule

D-2; β-cyclodextrin with one attached maltose molecule

D-3; γ-cyclodextrin with one attached maltose molecule

D-4; α-cyclodextrin with attached two maltose molecules

D-5; β-cyclodextrin with two attached maltose molecules

D-6; γ-cyclodextrin with two attached maltose molecules

D-7; α-cyclodextrin with three attached maltose molecules

D-8; β-cyclodextrin with three attached maltose molecules

D-9; γ-cyclodextrin with three attached maltose molecules

D-10; α-cyclodextrin with one attached glucose molecule

D-11; β-cyclodextrin with one attached glucose molecule

D-12; γ-cyclodextrin with one attached glucose molecule

D-13; α-cyclodextrin with two attached glucose molecules

D-14; β-cyclodextrin with two attached glucose molecules

D-15; γ-cyclodextrin with two attached glucose molecules

D-16; α-cyclodextrin with three attached glucose molecules

D-17; β-cyclodextrin with three attached glucose molecules

D-18; γ-cyclodextrin with three attached glucose molecules

With regard to the structure of the branched cyclodextrin, although many studies have been made by means of HPLC, NMR, TLC (Thin layer chromatography), INEPT (insentive nuclei enhanced by polarization transfer) etc., it is not clearly defined at present. However, it is definite that monosaccharide or disaccharide is attached to the cyclodextrin from the result of above-described measurements. Therefore, in cases where two or more molecules of the monosaccharide or disaccharide are attached, they may be attached to each glucose or to one glucose in the form of a straight chain, as schematically illustrated below.

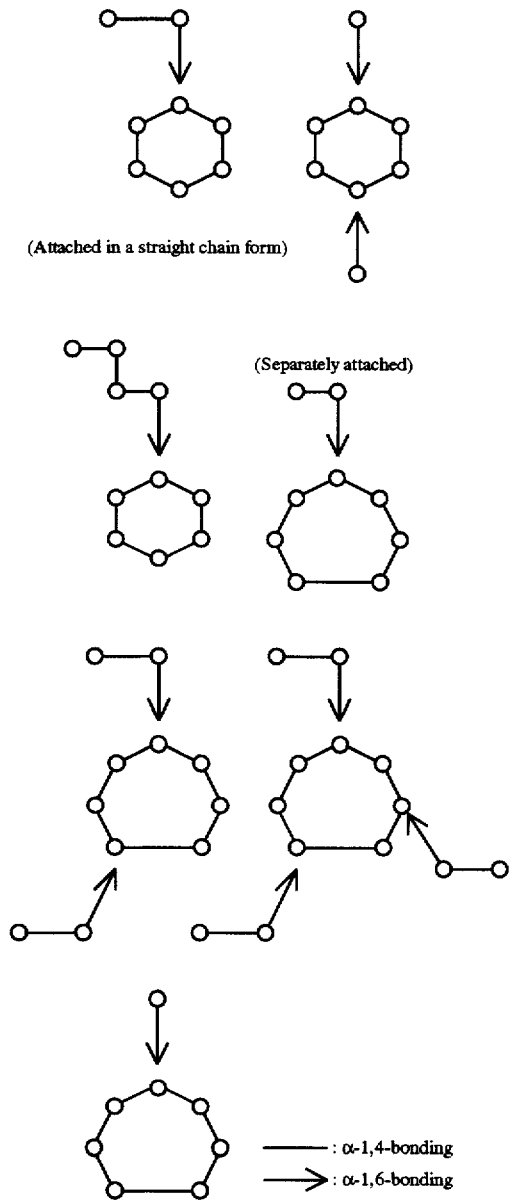

In the above, it is characterized in that the ring structure of the cyclodextrin is preserved so that it exhibits inclusion action similarly to cyclodextrin itself and a water soluble maltose or glucose is attached thereto to enhance its water solubility.

The branched cyclodextrin used in the invention is commercially available. Maltosylcyclodextrin, for example, is available as Isoelite P (trade mark, product by Ensuiko Seitoh Co.)

Next, the cyclodextrin polymer will be explained. The cyclodextrin polymer usable in the invention is represented by the following formula (Dp).

Formula (Dp)

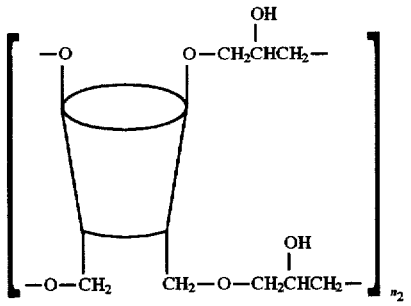

The cyclodextrin polymer can be prepared by cross-linking cyclodextrin with epichlorohydrin to form a polymer. In the above formula,

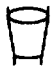

represents a cyclodextrin moiety. The cyclodextrin polymer is preferably water soluble, more preferably having a solubility of not less than 20 g per 100 g of water at 25° C. Accordingly, in formula (Dp), $n_2$ (alternatively, polymerization degree) is preferably 3 or 4. The smaller this value is, the higher solubility of the cyclodextrin polymer and its solubilizing effect.

These cyclodextrin polymers can be synthesized according to conventional methods described in JP-A 61-97025 and German Patent 3,544,842. The cyclodextrin polymer may be used as a inclusion compound. The cyclodextrin compound is incorporated in the solid developer replenishing composition in an amount so as to be preferably 0.2 to 100 g (more preferably, 0.5 to 40 g) per liter of a replenishing solution.

The solid developer replenishing composition of the invention preferably contains a restraining agent to improve process stability in running-processing. As examples of the restraining agent are cited known azoles such as benzothiazoliums, nitroindazoles, triazoles, and benzotriazoles (particularly, nitro- or halogen-substituted ones); heterocyclic mercapto compounds such as mercaptothiazoles, mercaptobenzthiazoles, mercaptobenzimidazoles, mercaptothiadizoles, mercaptotetrazoles (particularly, 1-phenyl-5-mercaptotetrazole)mercaptopyrimidines and the above-described mercapto compounds containing a solubilizing group such as a carboxyl group or sulfonic acid group; thioketo compounds such as oxazolinethione; azaindenes such as tetrazaindenes (particularly, 1,3,3a7-tetrazaindene); benzenethiosulfonic acids; benzenesulfinic acids; phenazines and anthraquinones. Among these compounds is preferred benzotriazoles.

The solid developer replenishing composition of the invention may contain an antisludging agent, such compounds as described in Japanese Patent 62-4702, JP-A 3-51844, 4-26838, 4-362942 and 1-319031. The solid developer replenishing composition may contain, as a preservative, sodium sulfite, potassium sulfite, ammonium sulfite and sodium metabisulfite. Furthermore, the solid developer replenishing composition may optionally contain an alkali agent (e.g., sodium hydroxide, potassium hydroxide etc.), pH buffering agent (e.g., carbonate, phosphate, borate, boric acid, acetic acid, citric acid, alkanolamine etc), dissolving aid (e.g., polyethylene glycols and their esters, alkanolamine etc.), sensitizer (e.g., nonionic surfactant including polyoxyethylenes, quaternary ammonium compound etc.), surfactant, deforming agent, chelating agent (e.g., ethylenediaminetetraacetic acid and its alkali metal salt, nitrilotriacetate, polyphosphate etc.), development-accelerating agent (e.g., compounds described in U.S. Pat. No. 2,304,025 and Japanese Patent 45-45541), hardener (e.g., glutar aldehyde and its bisulfite-adduct), and defoaming agent. The pH of a developing solution is preferably adjusted to 8.5 to 10.5 so as to complete processing within a total processing time of 60 sec. or less.

The compound represented by formula (1) used in the invention may be incorporated in a photographic material. In this case, the photographic material may be processed in an alkaline aqueous solution (so-called, activator processing solution) to be developed. Such processing is often employed as one of rapid processing methods, in combination with silver salt stabilization process by use of a thiocyanate. In such rapid a processing method, effects of the invention is remarkable.

The solid developer replenishing composition may be in the form of powder, granules, tablet paste or combination thereof. A kit may be comprised of one part or plural parts. The preferred shape is a granular or tablet form.

As a method of preparing solid developer replenishing composition in the form of granules are cited a rolling granulation, extruding granulation, compression granulation, spray-drying method and dissolving coagulation. Among these, extruding granulation and compression granulation are preferred.

The size and form of the granular developer replenishing composition are different depending on desired characteristics. Taking into account of solubility desired as a developer residual powder amount in a package and resistance to destruction due to vibration during transportation, the granular size 0.5 to 50 mm and preferably 1 to 15 mm, in sphere-equivalent diameter. The shape thereof may be cylindrical, spherical, cubic, or rectangular solid, preferably, spherical or cylindrical.

In cases of a tablet form, the size and form thereof are different depending on desired characteristics. The size is preferably 2 to 5 mm in diameter. To enhance solubility, a tabular tablet, one whose central portion is further thinned or tablet in a doughnut form is also usable. For the purpose of causing the tablet to dissolve slowly, the diameter may be increased. To control solubility the surface state may be changed to be flat or porous. To provide different solubility to plural granular compositions or adjust dissolution speed of materials different in solubility, plural shapes may be adopted. A multi-layered tablet different in internal and surface compositions.

In the case when replenished using the solid developer replenishing composition, the solid composition is at first dissolved in water and replenisher is provided in the form of a replenishing solution, or the solid composition and water both are directly supplied to a circulating portion of a developing bath.

In developing a silver halide photographic material with replenishing using the solid developer replenishing composition of the invention, the developing temperature may be 20° to 30° C., as in conventional development or 30° to 40° C., as in high temperature development.

Processing in the invention is carried out using an automatic processor, wherein a given amount of the solid developer replenishing composition is replenished to a developing solution in proportion to the amount of the photographic material to be processed. As a replenishing method are cited area-based replenishment described in JP-A 55-126242 and 60-104946, width-based replenishment described in JP-A55-126243, developed area-base replenishment described in JP-A 57-195245 and 57-195246, and continuous or intermittent replenishment in proportion to the processing amount, described in JP-A 62-238559. When replenished using the solid developer replenishing composition, to reduce effluent, the replenishing amount of a replenishing solution is 300 ml or less per $m^2$, preferably, 75 to 200 $m_l$ per $m^2$.

As a fixing solution, any one which are popularly known in the art can be used. The fixing solution is an aqueous solution containing a fixing agent and other additives, and pH of the fixing solution is usually between 3.8 and 5.8. For the fixing agent, for example, thiocyanates such as sodium thiosulfate, potassium thiosulfate, ammonium thiosulfate, sodium thiocyanate, potassium thiocyanate, ammonium thiocyanate and other organic sulfur compounds which are capable of producing a stable silver complex salts and are known in the art as fixing agents can be used.

A compound which functions as a hardening agent, including, for example, water-soluble aluminium salts such as aluminium chloride, aluminium sulfate, potassium alum, aldehyde compounds (such as glutar aldehyde or its sulfite adducts, etc.), etc. may be added into the fixing solution.

The fixing solution may contain, if necessary, preservers such as sulfites or metasulfites; pH buffers such as acetic acid, citric acid, etc.; pH adjuster such as sulfuric acid, or chelating agents capable of softening or hardening water, etc.

In light of a demand for shortening a total processing time, it is preferred that the overall processing time (Dry to Dry from the time when the front end of a film is put in to the processor to the time when all of the film comes out of the drying zone is between 10 and 60 sec. The total processing time is an overall process time necessary for processing a black-and-white photographic material, including developing, fixing, bleaching, washing or stabilizing, and drying steps. The total processing time of less than 10 sec. results in decrease in sensitivity or gradation and satisfactory photographic performance is not achieved. In the processor, a heat conductive member with a temperature of 90° C. or more (for example, a heat roller heated at 90°~130° C.) or radiating member by directly applying electricity to a radiating element such as tungsten, carbon, Nicrome, a mixture of zirconium oxide, yttrium oxide and thorium oxide, to heat and emit radiation, or by conducting thermal energy from a resistance pyrogeneous substance to a radiation emissive substance such as copper, stainless, nickel and various types of ceramics, to generate heat or radiate infrared rays can preferably be used in order to construct the heating zone. As a means for anti-mold, U.V. radiation method described in JP-A 60-263939; a technique by use of magnetic field, described in JP-A 60-263940; technique by use of a ion-exchange resin, described in JP-A 61-131632; and technique by use of anti-fungal agents, described in JP-A 62-11515, 62-153952, 62-220951 and 62-209532 are usable in the process according to the invention. Furthermore, an anti-mold and surfactant, described in L. E. West, "Water Quality Criteria" Photo. Sci. & Eng. Vol. 19 No. 6 (1965); M. W. Beach, "Microbiological Growths in Motion-picture Processing", SMPTE Journal Vol. 35 (1976); R. O. Deegan, "Photo. Processing Wash Water Biocides", Journal Imaging tech. Vol. 10 No. 6 (1984); JP-A 57-3542, 57-58143, 58-105145, 57-132146, 58-18631, 57-97530 and 57-157244 may be usable in therewith. In washing bath used in the invention, an isothiazoline compound described in R. T. Kreiman, J. Imag. Tech. Vol. 10 (6) 242 (1984) and Research Disclosure Vol. 205, 20526 (May, 1981) and compounds described in JP-A 61-209532 are usable as anti-mold.

Examples of the anti-mold include phenol, 4-chlorophenol, pentachlorophenol, cresol, o-phenylphenol, chlorophen, dichlorophen, formaldehyde, glutar aldehyde, chloroacetoamide, p-hydroxybenzoic acid ester, 2-(4-thiazoline)-benzoimidazole, benzoisothiazoline-3-one, dodecyl-benzyl-dimethylammoniumchloride, N-(fluorodichloromethylthio)-phthalimide and 2,4,4'-trichloro-2'-hydroxydiphenyl ether.

Various types of surfactants may be incorporated in washing water for the purpose of restraining water spot. The surfactant may be either of cationic type, anionic type, nonionic type or amphoteric type. Examples of the surfactant are referred to compounds described in "Handbook of Surfactants" published by Kohgaku Tosho Co.

Rinsing may be conducted in processing used in the invention. Various types of compounds may be incorporated in a rinsing bath for the purpose of stabilizing an image. For example, a buffering agent. for adjusting the pH, e.g., pH of 3 to 8 (e.g., borate, metaborate, borax, phosphate, sodium hydroxide, aqueous ammonia solution, monocarboxylic acid, dicarboxylic acid and polycarboxylic acid) and aldehyde such as Formalin are cited. Further, a chelating agent, fungicide (thiazoles, isothiazoles, halogenated phenols, sulfanylamides, benztriazoles etc.), surfactant, fluorescent brightening agent and hardener may also be usable singly or in combination thereof. Furthermore, as an agent for adjusting a pH of the layer may be incorporated an ammonium salt such as ammonium chloride, ammonium phosphate, ammonium sulfite or ammonium thiosulfate.

There is no specific limitation as to halide composition in the silver halide in the silver halide emulsion used in the present invention. Preferably, however, silver chlorobromide or iodobromochloride containing 60 mol % or more chloride is used.

The average grain size of the silver halide is preferably 0.7 μm or less, and, particularly 0.1–0.3 μm. The term "average grain diameter" has been used commonly among experts in the photographic science, and it is easily understood by them. The term "grain size" usually denotes the diameter of a grain, when the shape of the grain is of a spherical shape or one which can be approximated to it. In the case when the grain has a cubic shape, it means the diameter of the sphere when the cube is converted into a sphere having the equivalent volume. Detailed method of obtaining the average diameter, one can refer to the disclosure on pages 36–43, third edition of "The theory of the photographic process" written by C. E. Mees and T. H. James and published by Macmillan Co. in 1966.

There is no limitation as to the shape of the silver halide grain, and any one of tabular, cubic, spherical, tetradecahedral or octahedral shape can optionally be used. Concerning grain size distribution, the narrower, the more preferable. Particularly, so-called mono-dispersed emulsion, in which more than 90%) preferably 95%) of the total number of grains fall in the range ±40% around the average grain size, is preferable.

The type of reaction of a soluble silver salt with soluble halide in the preparation of a silver halide emulsion may be normal precipitation, double jet precipitation or combination thereof. A method of forming grains in the presence of silver ions in excess (so-called, reversed precipitation) may be applicable. As one of the double jet precipitation is used a controlled double jet method in which the pAg of liquid phase is maintained at a given value during the course of grain formation. According to this method, there can be obtained a silver halide emulsion comprised of monodispersed grains with regular crystal form.

During the course of nuclear grain formation and growth thereof, a transition metal salt of group VIII, such as cadmium, lead, zinc, thallium, ruthenium, rhenium, osmium, iridium or rhodium or their complex salt may be incorporated. The addition amount thereof is $10^{-8}$ to $10^{-4}$ mol per mol of silver halide. As preferred transitional metals are cited rhodium and rhenium.

Silver halide emulsions and preparation methods thereof are described in detail in Research Disclosure (RD) Vol. 176, 17643 pages 22–23 (Dec., 1078).

The silver halide emulsion used in the present invention may or may not be sensitized chemically. As method of chemical sensitization, sulfur sensitization, selenium sensitization, tellurium sensitization, reduction sensitization and noble metal sensitization have been well known in the art, and these methods may be used either singly or in combination. As a sulfur sensitizer conventionally known sulfur sensitizers may be used. Preferable sulfur sensitizers include, for example, besides sulfur compounds contained in gelatin, various sulfur compounds, for example, thiosulfates, thio ureas, rhodanines, polysulfide compounds, etc. can be used. As selenium sensitizers, known selenium sensitizers may be used. For example, those compounds disclosed in U.S. Pat. No. 1,623,499, Japanese Patent O.P.I. Publication Nos.50-71325 (2975) and 60-150046 (1985) may preferably be used.

Among noble metal sensitizations, gold sensitization is representative, and gold compounds, mainly gold complexes are used. Other noble metal compounds, for example, complexes of platinum, paradium, rhodium, etc. may also be used. As reduction sensitizers, stannous salts, amines, formamidine sulfinic acids silane compounds, etc. can be used.

The silver halide emulsion may be spectrally sensitized to an optional spectral wavelength with a sensitizing dye. Useful sensitizing dye includes, for example, cyanine dyes, merocyanine dyes, complex cyanine dyes, complex merocyanine dyes, holopolar cyanine dyes, hemicyanine dyes, styryl dyes, and hemioxonol dyes. To these dyes, any nucleus applied to the cyanine dyes may be applied as a basic heterocyclic nucleus. That is to say, pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; and those nuclei fused with an alicyclic hydrocarbon ring or an aromatic hydrocarbon ring, i.e., indolenin nucleus, benzindolenin nucleus, indole nucleus, benzoxazole nucleus, naphthoxazole nucleus, benzthiazole nucleus, naphthothiazole nucleus, benzselenazole nucleus, benzimidazole nucleus, quiunoline nucleus, etc. may be applied. These nuclei may be substituted on a carbon atom thereof. To merocyanine dyes or complex merocyanine dyes, as a nucleus having a ketomethylene structure, five-membered or six-membered heterocycle, such as thiohydantoin nucleus, 2-thiooxazolidine-2,4-di-one nucleus, rhodanin nucleus, thiobarbituric acid nucleus, etc. can be applied. More specifically, those compounds disclosed in Research Disclosure (RD) No. 17643, on pages 2 and 3 (December 1978), U.S. Pat. Nos. 4,425,425, 4,425,426 can be used. The sensitizing dye may be dissolved by means of ultrasonic dispersion disclosed in U.S. Pat. No. 3,485,634. As other methods for dissolving or incorporating the sensitizing dye used in the present invention in the emulsion, those methods disclosed in U.S. Pat. Nos. 3,482,981, 3,585,195, 3,469,987, 3,425,835, 3,342,605; British Patent Nos. 1,271,329, 1,038,029, 1,121,174; U.S. Pat. Nos. 3,660,101 and 3,658,634 can be used. These sensitizing dyes may be used either singly or in combination. Combined use of the sensitizing dyes are often employed for the purpose of super-sensitization. Useful combinations of the sensitizing dyes exhibiting super-sensitization are disclosed in Research Disclosure (RD) No. 17643 (December 1978), on page 23 IV-J.

In the light-sensitive material according to the present invention can comprise a variety of compounds for the purpose of preventing fog during manufacture, storage or photographic processing of the light-sensitive material. Those compounds include compounds which are known as stabilizers or anti-foggants in the art. For example, azoles such as benzthiazolium salts, nitroindazoles, chlorobenzimidazoles, bromobenzimidazoles, mercaptothiazoles, mercaptobenzthiazoles, mercaptobenzimidazoles, mercaptobenzthiadiazoles, aminotriazoles, benztriazoles, nitrobenztriazoles, mercaptotetrazoles, such as 1-phenyl-5-mercaptotetrazole, etc.; mercaptopyrimidines, mercaptotriazines, thioketo compounds such as oxazolinthione; azaindenes such as triazaindenes, tetrazaindenes including 4-hydroxy-substituted 1,3,3a,7-tetrazaindenes, pentazaindenes, etc., benzenethiosulfonic acid, benzenesulfinic acid, benzenesulfonic acid amide, etc. can be mentioned.

A silver halide emulsion layer or light-insensitive hydrophilic colloidal layer used in the invention may contains an or inorganic hardener, such as chromium salts (chrome alum, chrome acetate etc.), aldehydes (formaldehyde, glutar aldehyde, glyoxal etc.), N-methylol compounds (dimethylol urea, dimethylol dimethylhydantoin etc.), dioxane derives (2,3-dihydroxydioxane), active vinyl compounds (1,3,5-triacryloyl-hexahydro-s-triazine, bis)vinylsulfonyl)methyl ether, N,N-methylenebis-[β-(vinylsulfonyl)propioneamide], etc.), active halogen compounds (2,4-dichloro-6-hydroxy-s-triazine, etc.), mucohalogenic acids (mucochloric acid, phenoxymucochloric acid, etc.) isooxazoles, dialdehyde starch, 2-chloro-6-hydroxytriazinyl gelatin, and peptide type hardeners described in JP-A 1-198774, 5-61139 and Japanese Patent Application No. 6-194168, singly or in combination thereof.

The silver halide emulsion layer or light-insensitive hydrophilic colloidal layer may optionally contain a coating aid, antistatic agent, slipping agent, emulsifying agent and various additives for preventing adhesion or improving photographic characteristics.

As binder or a protective colloid of the photographic emulsion used in the present invention, gelatin is advantageously used, however, other hydrophilic colloids may also be used. The hydrophilic colloids include, for example, gelatin derivatives, graft polymers comprised of gelatin and other polymers; proteins such as casein, albumin, etc.; cellulose derivatives such as hydroxyethyl cellulose, carboxymethyl cellulose, cellulose sulfates, etc.; sugar derivatives such as sodium alginate, starch derivatives, etc.; synthetic hydrophilic polymers such as polyvinyl alcohol and partial acetal thereof, poly-N-pyrrolidone, polyacrylic acid, polymethacrylic acid, polyacrylamide, polyvinyl imidazole, polyvinyl pyrazole, etc. These polymers may be either homopolymers or copolymers. As gelatin, there may be usable an acid process gelatin as well as lime-processed gelatin. Further, hydrolytic products or enzyme decomposition products of gelatin may also be used.

In the photographic emulsion according to the present invention, for the purpose of improving dimensional stability, etc., synthetic polymers which are water-insoluble, or sparingly water-soluble can be incorporated. For example, alkyl(metha)acrylates, alkoxy(metha)acrylates, glycidyl(metha)acrylates, (metha)acrylamides, vinyl esters such as vinyl acetate, acrylonitrile, styrene, etc. may be used either singly or in combination. Further, these polymers may be used in the form of a copolymer together with other monomer constituents such as acrylic acid, methacrylic acid, α,β-unsaturated dicarboxylic acid, hydroxylalkyl(metha) acrylate, sulfoalkyl(metha)acrylate, styrene sulfonic acid, etc.

A silver halide photographic light sensitive material used in the invention preferably comprised a hydrazine compound. The hydrazine compound is represented by the following formula (H).

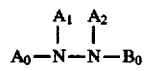

Formula (H)

In the Formula, $A_0$ is an aliphatic hydrocarbon group, aromatic hydrocarbon group or heterocyclic group. An aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfooxy, sulfamoyl, acylamino and ureido).

An aromatic group represented by $A_0$ of formula (H) is preferably a monocyclic or condensed-polycyclic aryl group such as a benzene ring or naphthalene ring.

A heterocyclic group represented by $A_0$ of formula (H) is preferably a monocyclic or condensed-polycyclic one containing at least one hetero-atom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring.

$A_0$ is preferably an aryl group or heterocyclic group, which preferably be substituted. As examples of substituents are cited an alkyl group, aralkyl group, alkenyl group, alkynyl group, alkoxy group, substituted amino group, acylamino group, sulfonyl amino group, ureido group, urethane group, aryloxy group, sulfamoyl group, carbamoyl group, alkylthio group, arylthio group, sulfothio group, sulfinyl group, hydroxy group, halogen atom, cyano group, sulfo group, alkyloxycarbonyl group, aryloxycarbonyl group, acyl group, alkoxycarbonyl group, acyloxy group, carbonamido group, sulfonamido group, carboxy group, phosphoamido group. These groups may be further substituted.

Among these groups are preferred those having an acidic group of pKa of 7 to 11, when processed with a developer having a pH of 10.5 or less within 60 sec. Examples thereof are sulfonamido group, hydroxy group, mercapto group, preferably, sufonamido group.

$A_0$ contains preferably a nondiffusible group or a group for promoting adsorption to silver halide. As the nondiffusible group is preferable a ballast group used in immobile photographic additives such as a coupler. The ballast group includes an alkyl group, alkenyl group, alkynyl group, alkoxy group, phenyl group, pheoxy group and alkylpheoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A-64-90439.

$B_0$ is a blocking group represented by $-G_0-D_0$, wherein $G_0$ is a —CO—, —COCOA—, —CS—, —C(=$NG_1D_1$)—, —SO—, —$SO_2$— or —P(O)($G_1D_1$)— group. $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other.

$D_0$ represents an aliphatic group, aromatic group, heterocyclic group, amino group, alkoxy group or mercapto group.

$G_0$ is preferably a —CO— or —COCO— group, more preferably a —COCO— group. $D_0$ is preferably a hydrogen atom, alkoxy group or amino group.

$A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxalyl).

A compound represented by formula [H] is exemplified as below, but the present invention is not limited thereto.

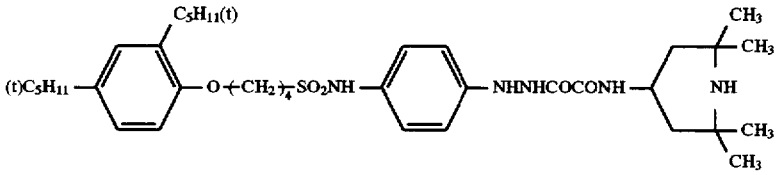

H-1

-continued
H-2
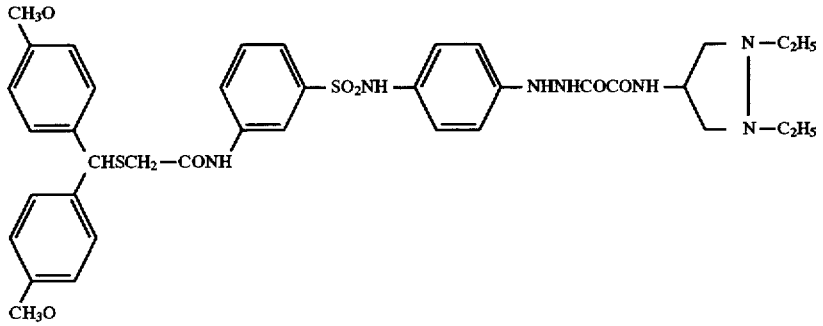
H-3
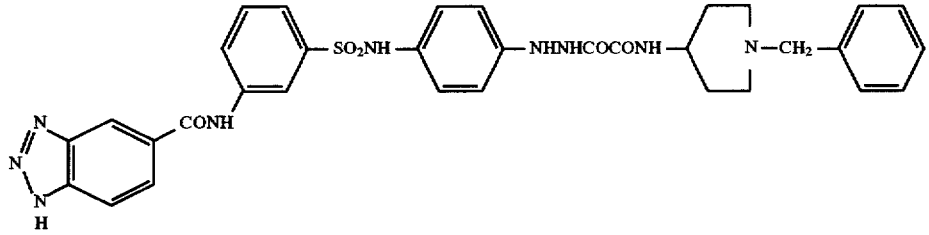
H-4
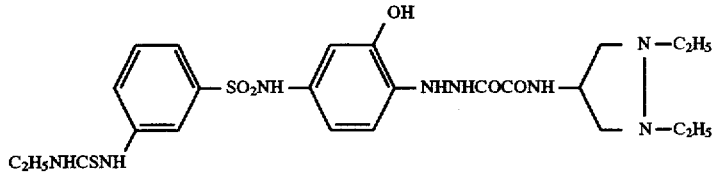
H-5
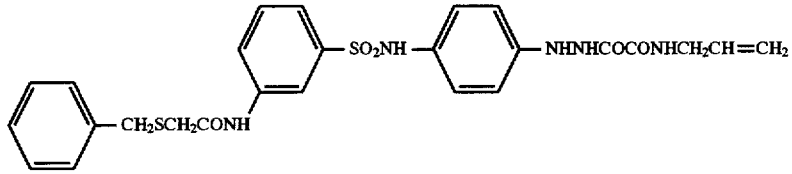
H-6
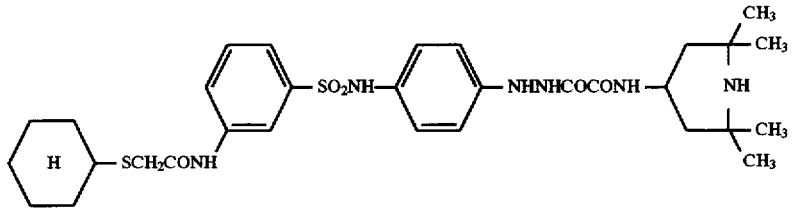
H-7
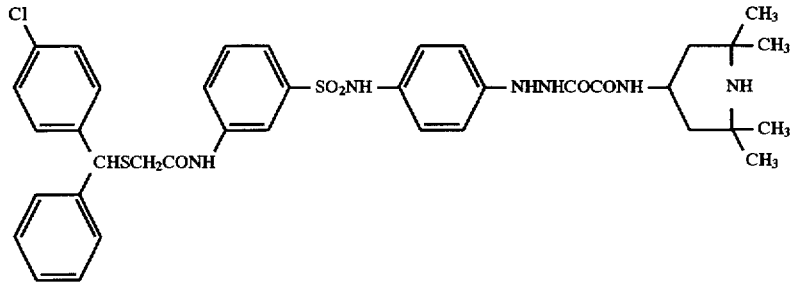
H-8
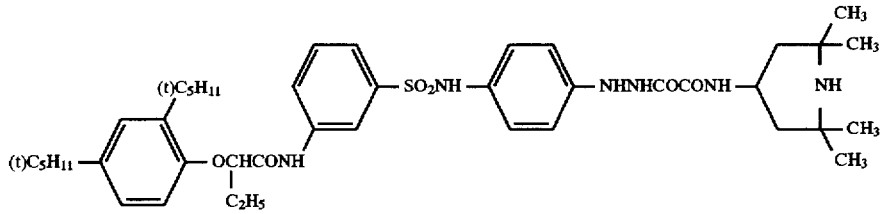

-continued
H-9
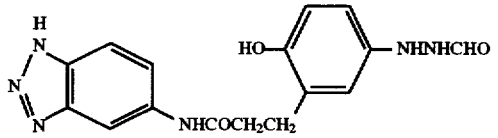
H-10
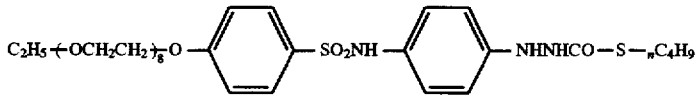
H-11
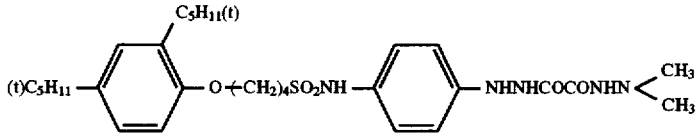
H-12
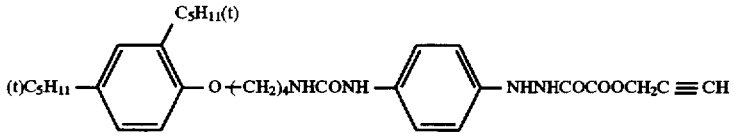
H-13
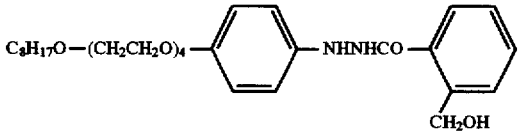
H-14
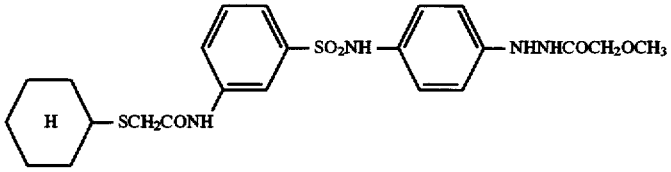
H-15
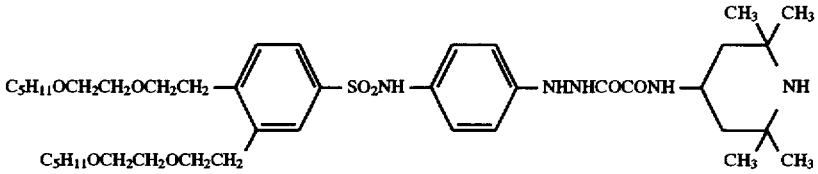
H-16
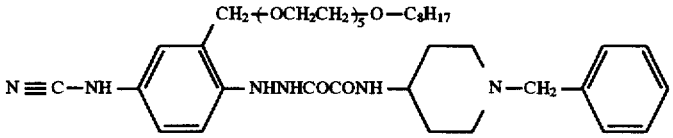
H-17
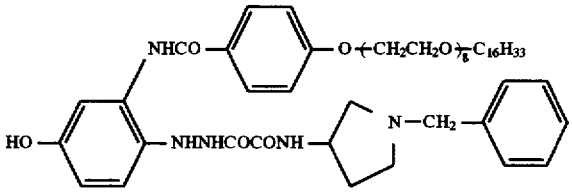
H-18
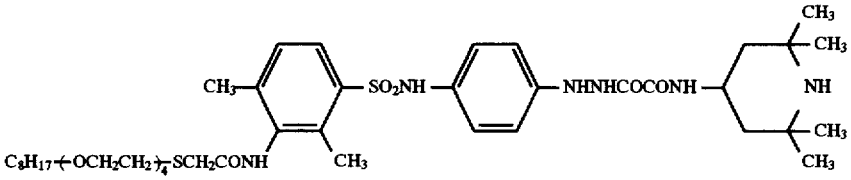

-continued

H-19

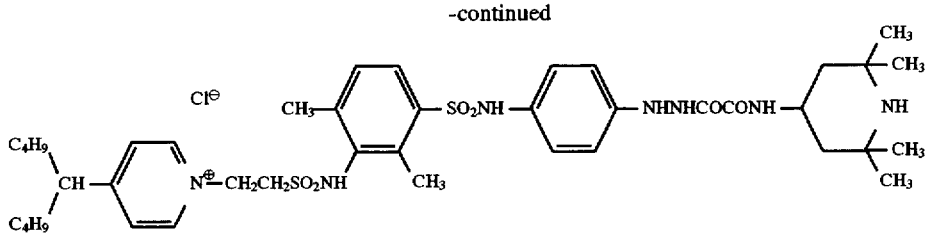

H-20

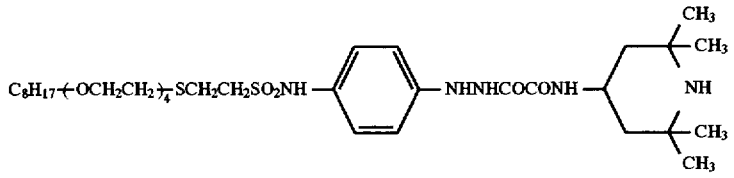

H-21

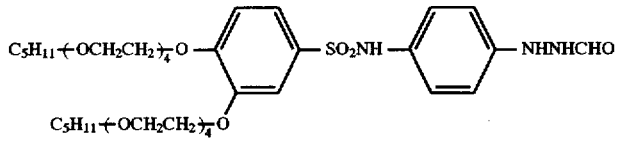

H-22

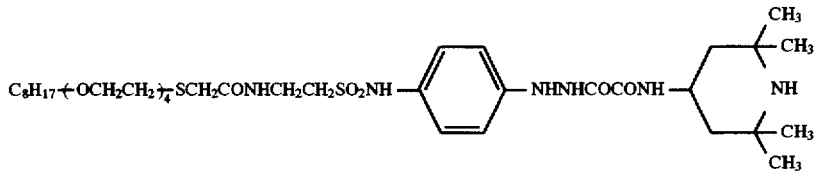

H-23

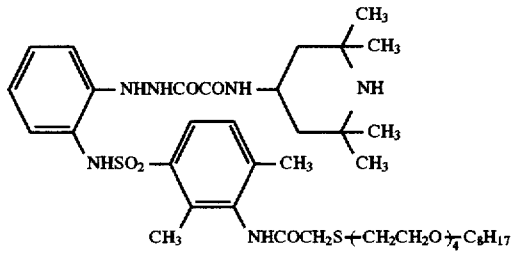

H-24

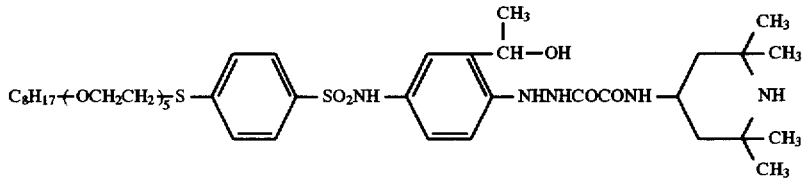

H-25

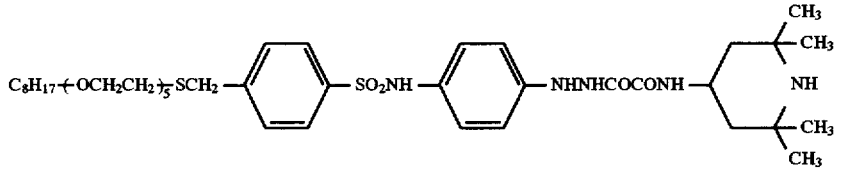

The hydrazine derivative may be added in an amount capable of contrast-increasing the light-sensitive photographic material according to the present invention, and the optimum amount of addition may be varied depending on the size, halide composition, degree of chemical ripening of silver halide grains and kind of restraining agent used, however, it is generally between $10^{-6}$ and $10^{-1}$ mol, and, more preferably, between $10^{-5}$ and $10^{-2}$ mol per one mol of silver halide. The hydrazine derivative used in the present invention is preferably incorporated either in the silver halide emulsion layer or a layer contiguous thereto.

In order to accelerate effectively the contrast-increase by the hydrazine derivative, it is preferable to use a nucleation accelerating compound represented by the following general formula (Na) or (Nb).

General Formula (Na)

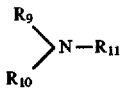

-continued

General Formula (Nb)

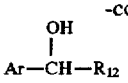

In the Formula (Na), $R_9$,$R_{10}$ and $R_{11}$ independently represent a hydrogen atom, an alkyl group, a substituted alkyl group, an alkenyl group, a substituted alkenyl group, an alkinyl group, an aryl group or a substituted aryl group, provided that $R_9$, $R_{10}$ and $R_{11}$ can combine with each other to form a ring. Among the compounds represented by formula (Na) is preferable an aliphatic tertiary amine compound. It is preferable for these compounds to contain in their molecules a diffusion-proof group or a silver halide-adsorbing group. In order to be non-diffusible, the compound has preferably a molecular weight of 100 or more and, more preferably, not less than 300. As a preferable adsorbing group, for example, a heterocyclic group, a mercapto group, a thioether group, a thion group, thiourea group, etc. can be mentioned. As particularly preferable compound represented by the general formula (Na), a compound having in its molecule at least one thioether group as the silver halide adsorbing group can be mentioned.

As a preferred embodiment of the compound represented by formula (Na) is cited a compound represented by the following formula (Na-a).

Formula (Na-a)

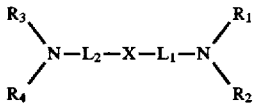

In the formula, $R_1$, $R_2$, $R_3$ and $R_4$ each are a hydrogen atom, an alkyl group, a substituted alkyl group, an alkenyl group, a substituted alkenyl group, an alkinyl group, a substituted alkinyl group, an aryl group or a substituted aryl group, or saturated or unsaturated heterocyclic group, provided that all of $R_1$, $R_2$, $R_3$ and $R_4$ are hydrogen atoms at the same time. $R_1$, $R_2$, $R_3$ and $R_4$ may combine together to form a ring. X is S, Se or Te atom. $L_1$ and $L_2$ are a bivalent linkage group, such as $—CH_2—$, $—CH=CH—$, $—C_2H_4—$, pyridyl, $—N(Z_1)—$, —O—, —S—, —(CO)—, $—(SO_2)—$, $—CH_2N—$, in which $Z_1$ is a hydrogen atom, alkyl group or aryl group. These groups may be substituted by an alkylene group, alkenylene group, arylene group acylamino group or sulfonamido group. The linkage group has preferably at least one of the following structure:

$—CH_2CH_2O—$, $—C(CH_3)HCH_2O—$, $—OC(CH_3)HCH_2O—$, $—OCH_2C(OH)HCH_2—$

Below, specific nucleation accelerating compounds represented by the General Formula (Na) are given.

Na-1

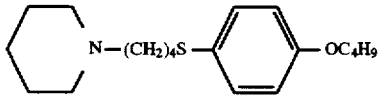

Na-2

$[(C_3H_7)_2N(CH_2)_3OCH_2CH_2]_2S$

Na-3

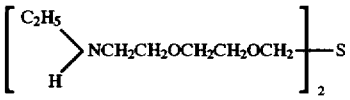

-continued

Na-4

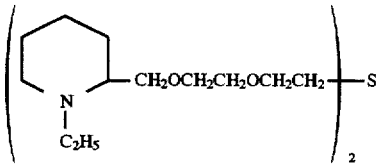

Na-5

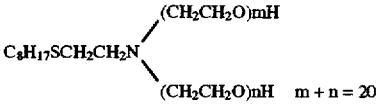

Na-6

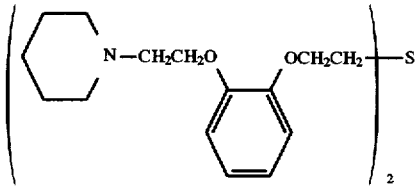

Na-7

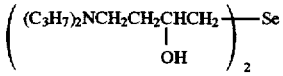

Na-8

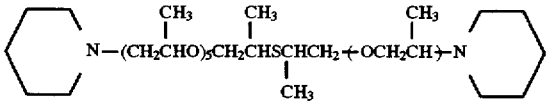

Na-9

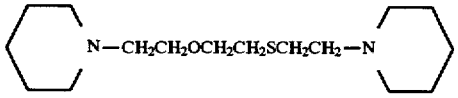

Na-10

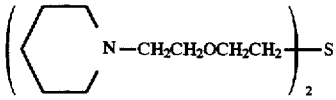

Na-11

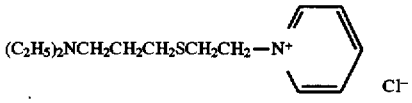

Na-12

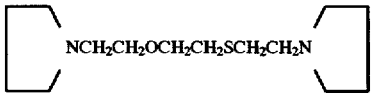

Na-13

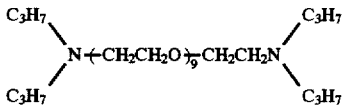

Na-14

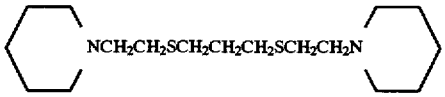

Na-15

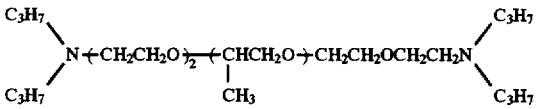

Na-16

$((C_2H_5)_2N(CH_2)_3NHCOCH_2)_2Se$

-continued

Na-17

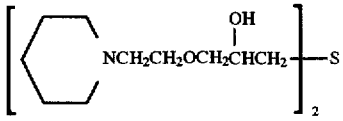

Na-18

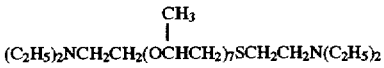

Na-19

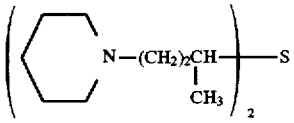

Na-20

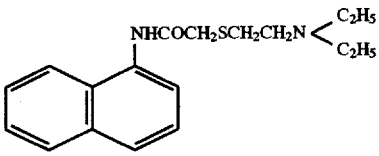

In the general Formula (Nb), Ar represents a substituted or unsubstituted aromatic hydrocarbon group or a heterocyclic group. $R_{12}$ represents a hydrogen atom, an alkyl group, an alkenyl group, an alkynyl group, or an aryl group, provided that Ar and $R_{12}$ may form a ring through a connecting group. The compound preferably contain in its molecule an diffusion-proof group or a silver halide-adsorbing group. The molecular weight to confer diffusion-proof property on the compound is 120 or more, and, more preferably, 300 or more. Further, as preferable silver halide-adsorbing group, the same group defined as the silver halide-adsorbing group in the General Formula (H) can be mentioned.

Specific exemplified compounds represented by the General Formula (Nb) are given below.

Nb-1

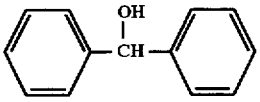

Nb-2

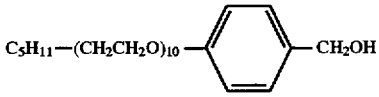

Nb-3

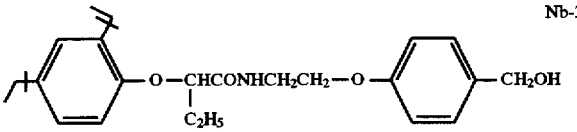

Nb-4

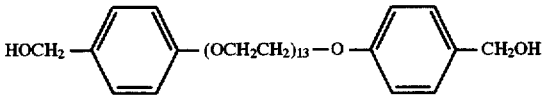

Nb-5

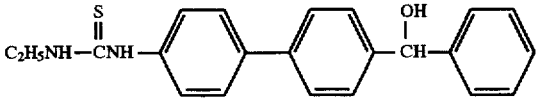

Nb-6

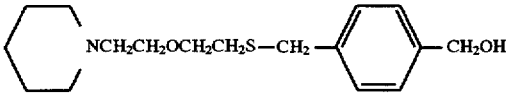

-continued

Nb-7

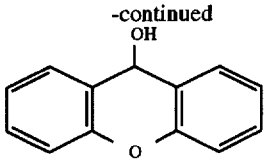

Nb-8

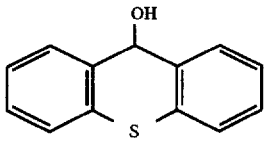

Nb-9

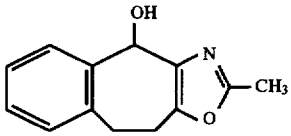

Nb-10

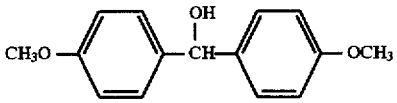

Nb-11

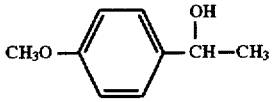

Nb-12

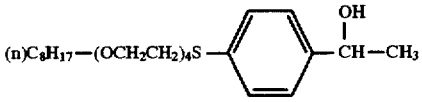

In addition, specific examples of the nucleation accelerating compounds include exemplified Compounds (2-1) through (2–20) disclosed in paragraphs (0062) on Page 13 through (0065) on page 15 in Japanese Patent OPI Publication No. 6-258751 (1994) and exemplified Compounds 3-1 to 3-6 disclosed in paragraphs (0067) on page 15 trhrough (0068) on page 16 in Japanese Patent OPI Publication No. 6-258751 (1994).

The nucleation accelerating compounds may be used in any layer located on the side of the silver halide emulsion layer. Preferably the compounds are incorporated either in the silver halide emulsion layer or a layer adjacent thereto.

In the present invention, a silver halide emulsion layer or a hydrophilic colloidal layer may contain a tetrazolium compound represented by the General Formula (T) below.

General Formula (T)

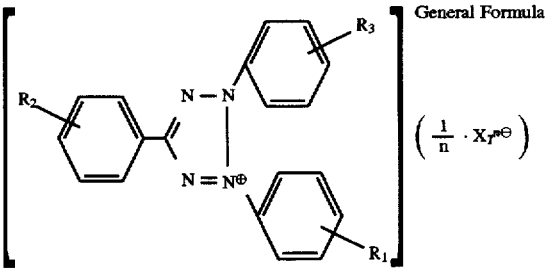

Each of $R_1$,$R_2$ and $R_3$ preferably represents a hydrogen atom or a group, of which Hammett's σ-value showing degree of electron attraction is negative.

The σ values of the phenyl substitution are disclosed in lots of reference books. For example, a report by C. Hansch in "The Journal of Medical Chemistry", vol. 20, on page 304 (1977), etc. can be mentioned. Groups showing particularly preferable negative σ-values include, for example, methyl group ($\sigma_p$=−0.17, and in the following, values in the are in terms of $\sigma_p$ value), ethyl group(−0.15), cyclopropyl group (−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the general formula T according to the present invention.

n represents 1 or 2, and as anions represented by $X^{n-}_T$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, specifically including lower alkyl benzenesulfonic acid anions such as p-toluenesulfonic anion, etc.; alkylbenzene sulfonic acid anions such as p-dodecyl benzenesulfonic acid anion, etc.; higher alkyl sulfate anions such as lauryl sulfate anion, etc.; Boric acid-type anions such as tetraphenyl boron, etc.; succinate anions such as di-2-ethylhexylsulfo succinate anion, etc.; sulfate anions such as cetyl polyethenoxy sulfate anion, etc.; higher aliphatic acid anions such as stearic acid anion, etc.; and those in which an anionic radical is attached to a polymer, such as polyacrylic acid anion, etc. can be mentioned.

Specific exemplified compounds represented by the general formula T are given. However, the scope of the present invention is not limited by these tetrazolium compounds.

| Compound | $R_1$ | $R_2$ | $R_3$ | $X_T^{nT-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | P-$NH_3$ | H | H | $Cl^-$ |
| T-18 | p-$CH_3$ | H | p-$CH_3$ | $ClO_4^-$ |

The above-mentioned tetrazolium compounds can be synthesized according to the method discribed in Chem. Rev. Vol 55, pages 335–483. The tetrazolium compound may be added singly or in combination thereof.

The hydrazine compound, pyridynium compound described below, nucleation accelerating agent or tetrazolium compound used in the invention may be added any of layers provided in the photographic material, preferably, in a silver halide emulsion laye or adjacent layer thereto. The addition amount, which is dependent of the grain size, halide composition and degree of chemical sensitization of silver halide and kind of a restraining agent, is a range of $10^{-6}$ to $10^{-1}$, preferably, $10^{-5}$ to $10^{-2}$ mol per mol of silver halide.

Next, as a pyridinium compound used in a silver halide photographic light sensitive material relating to the invention are cited pyridinium salt compounds and derivative thereof, and quinolinium compounds and derivatives thereof (hereinafter, these compounds compounds are referred to as pyridinium compounds).

The pyridinium compound and quinolinium compound are represented by the following formulas (N-1) and (N-2), respectively.

Formula (N-1)

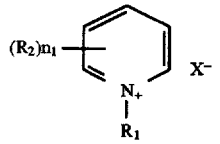

In formula (N-1), $R_1$ is an amino group, alkyl-substituted amino group (e.g., N-methylamino, N,N-dimethylamino, etc.), aromatic hydrocarbon group, such as phenyl or pyridyl or -A-Z, in which A is an alkyl group having 1 to 20 carbon atoms or —$CH_2CH{=}CHCH_2$—, Z is a hydrogen atom, phenyl group (which may be substituted), hydroxy group, alkoxy group such as methoxy or ethoxy, acyl group such as acetyl or benzoyl, alkoxycarbonyl group such as methoxycarbonyl or ethoxycarbonyl, cyano group, N-alkylamido group, amido group, or a group represented by the following formula (N-1a).

Formula (N-1a)

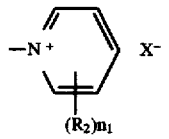

In formulas (N-1) and (N-1a), $R_2$ is a lower alkyl group (methyl group, ethyl group, propyl group, butyl group, etc.), hydroxy group, alkoxy group, a lower alkyl group substituted by an aromatic group such as phenyl or pyridyl group (2-hydroxyethyl, 3-hydroxypropyl, 2-methoxyethyl, 4-ethoxybutyl, benzyl, 2-ethylphenyl, 3-(4-pyridyl)propyl, etc.), amido group (=$CONH_2$, —$NHSO_2C_5H_{11}$, —$NHSO_2Ph$, etc.); and $n_1$ is an integer of 0, 1, 2 and 3, provided that, when $R_2$ is plural, they may be different from each other. $X^-$ is an anion such as iodide ion, bromide ion, chloride ion, p-toluenesulfonate ion, perchlorate ion, or methysulfate ion, provided that, when formula (N-1) is betaine structure, X is not present.

Formula (N-2)

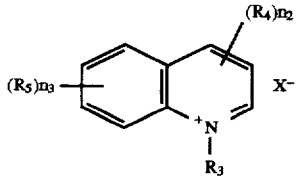

In formula (N-2), $R_3$ is a substituted or unsubstituted lower alkyl group, alkyl group or alkynyl group. As a preferred substituent are cited a hydroxy group; lower alkoxy group such as methoxy or ethoxy; aromatic hydrocarbon group such as phenyl; acyl group such as acetyl or benzoyl; alkoxycarbonyl group such as methoxycarbonyl or ethoxycarbonyl; amido group or cyano group. Examples of $R_3$ include methyl, ethyl, n-propyl, isopropyl, n-butyl, isobutyl, pentyl, 2-hydroxypropyl, 3-hydroxypropyl, 2-methoxypropyl, 3-ethylpropyl, 2-phenylethyl, 3-acetylpropyl, 2-benzoylethyl, 2-methoxycarbonylethyl, 2-cyanoethyl, 2-carbamoylethyl, butenyl, propargyl, benzyl, toluyl and phenethyl.

$R_4$ and $R_5$ independently are a halogen atom, lower alkyl group (e.g., methyl, ethyl, n-propyl, isopropyl, n-butyl, isobutyl, pentyl, etc.), substituted lower alkyl group or alkoxy group (e.g., methoxy, ethoxy, etc.). As a substituent of the substituted alkyl group are preferably a hydroxy group, lower alkoxy group, and substituted or unsubstituted aromatic hydrocarbon group (e.g., phenyl, alkyl-substituted phenyl, etc.). Examples of the substituted lower alkyl group include hydroxymethyl, 2-hydroxyethyl, 3-hydroxypropyl, 2-methoxyethyl, 2-ethoxyethyl, benzyl, 2-phenylethyl and 2-tolylethyl.

$n_2$ and $n_3$ each are 0 or 2. When $R_4$ and/or $R_5$ are plural number, they may be different from each other or may form a ring between them (e.g., 5-membered ring, 6-membered ring and 7-membered ring) . $X^-$ is an anion such as iodide ion, bromide ion, chloride ion, p-toluenesulfonate ion, perchlorate ion, or methysulfate ion, provided that, when formula (N-2) is betaine structure, X is not present.

Formula (N-3)

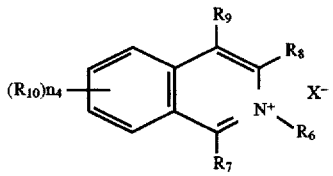

In formula (N-3), $R_6$ is an alkyl group (e.g., methyl, ethyl, propyl, butyl, pentyl etc.) or substituted alkyl group.

$R_6$ and $R_8$ may combine together with each other to form a 6-membered or 5-membered ring. $R_7$ is a hydrogen atom, lower alkyl group (e.g., methyl, ethyl, propyl, butyl, pentyl, etc.), substituted alkyl or aryl) e.g., phenyl, alkyl-substituted phenyl, etc.). As a substituent of the substituted alkyl group of $R_6$ and $R_7$ are cited hydroxy group, alkoxy group (e.g., methoxy, ethoxy, etc.), aryl group (e.g., phenyl, alkyl-substituted phenyl, etc.). Examples of the substituted alkyl group include 2-hydroxyethyl, 3-hydroxypropyl, 2-methoxyethyl, 2-ethoxyethyl, benzyl, 2-phenylethyl.

$R_8$ and $R_9$ each are a hydrogen atom, lower alkyl group,) e.g., methyl, ethyl, propyl, etc.), hydroxy group, lower alkyl group substituted by a group such as alkoxy (e.g., 2-hydroxyethyl, 3-hydroxypropyl, 2-methoxyethyl, 2-ethoxypropyl, etc.) or amido group.

$R_8$ and $R_9$ may combine together to form a 5-membered or 6-membered ring or aromatic ring. $R_{10}$ is a hydrogen atom, (e.g., chlorine atom, bromine atom, etc.), lower alkyl group, which may be substituted (methyl, ethyl, propyl, 2-hydroxyethyl, 3-hydroxypropyl, 2-methoxyethyl, benzyl, etc.), alkoxy group (e.g., methoxy, ethoxy, etc.) or amino group, which may be substituted by an alkyl group.

$n_4$ is 0, 1 or 2. When $R_{10}$ is plural, they may be different with each other. $X^-$ is an anion such as iodide ion, bromide ion, chloride ion, p-toluenesulfonate ion, perchlorate ion, or methysulfate ion, provided that, when formula (N-2) is betaine structure, X is not present.

The pyridinium and quinolinium compounds used in a silver halide photographic material relating to the invention each have a reduction potential of −0.60 V or less, preferably, −0.80 V or less. The reduction potential (Rred) means a potential at which the pyridinium compound is subjected to electron-injection at cathode to be reduces, in voltantometry. The reduction potential (Ered) can be accurately determined in voltantometry. Thus, a voltamogram of the pyridinium compound of $1\times10^{-4}$ to $1\times10^{-3}$ mol is measured in acetonitrile containing 0.1 mol of tetra-n-butylammonium perchlorate as supporting electrolyte, from which a half-wave potential is obtained. In this case, there are employed platinum as a working electrode and saturated calomel electrode (SCE) as a reference electrode at 25° C. Further details thereof are referred to U.S. Pat. No. 3,501,307 and P. Delahay, "New Instrumental Methods in Electrochemistry" (Interscience Publisher, 1954).

Examples of the pyridinium compound usable in the invention are shown below, but the invention is not limited thereto.

N-1

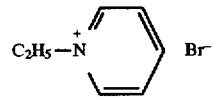

N-2

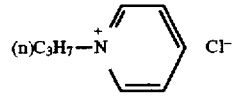

N-3

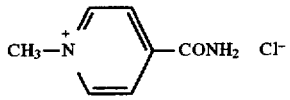

N-4

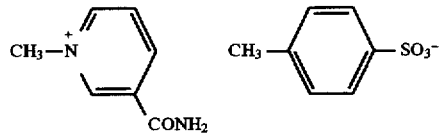

N-5

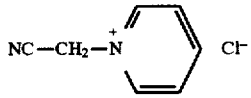

N-6

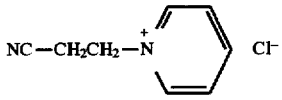

N-7

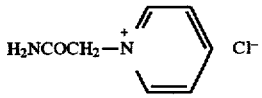

N-8

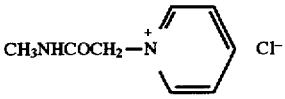

N-9

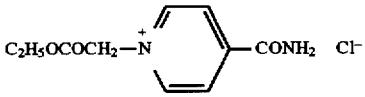

N-10

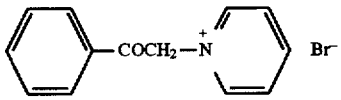

N-11

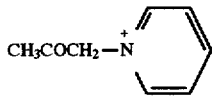

N-12

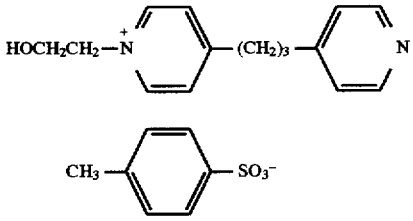

N-13

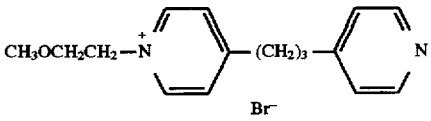

-continued
N-14
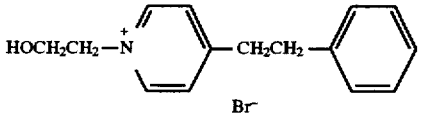
N-15
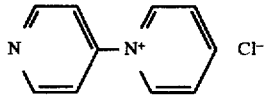
N-16
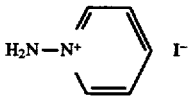
N-17
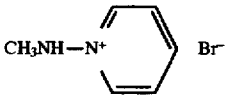
N-18
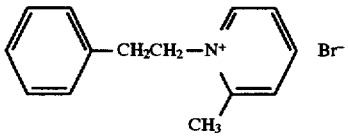
N-19
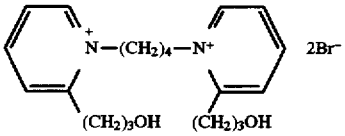
N-20
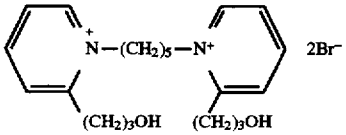
N-21
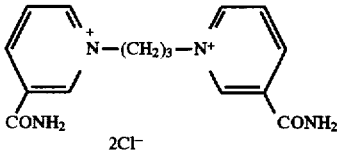
N-22
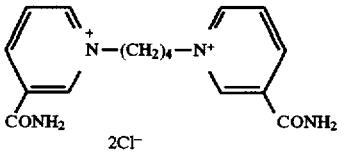
N-23
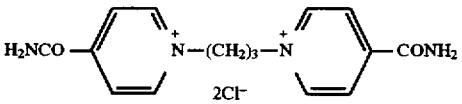
N-24
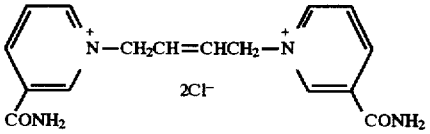
N-25
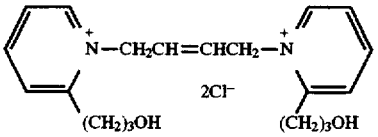
-continued
N-26
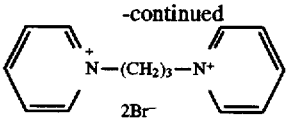
N-27
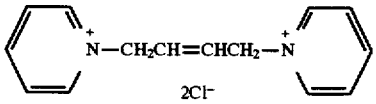
N-28
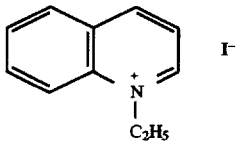
N-29
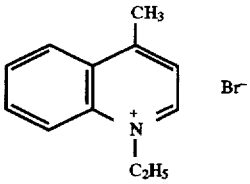
N-30
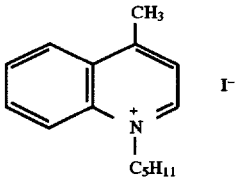
N-31
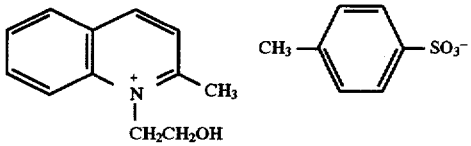
N-32
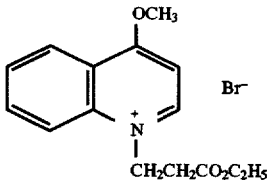
N-33
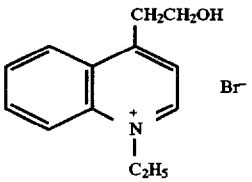
N-34
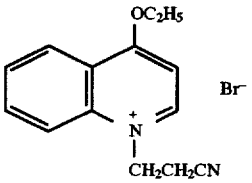
N-35
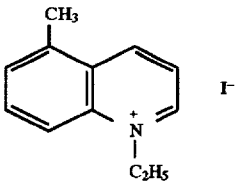

-continued
N-36
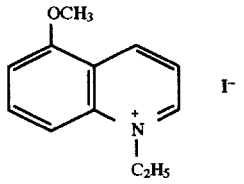
N-37
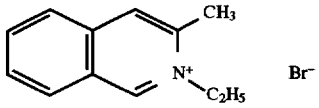
N-38
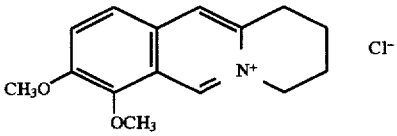
N-39
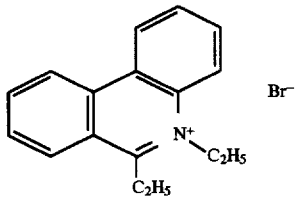
N-40
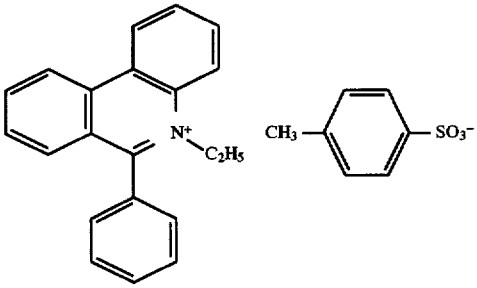
N-41
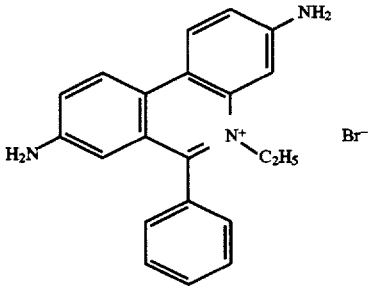
N-42
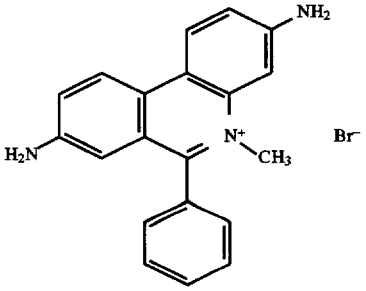
-continued
N-43
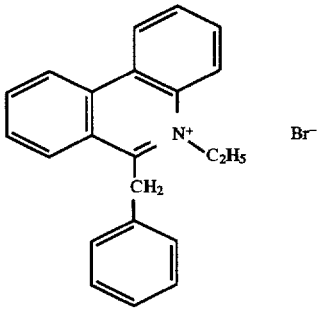
N-44
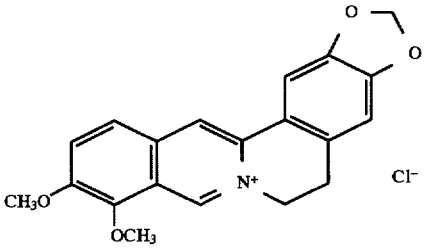
N-45
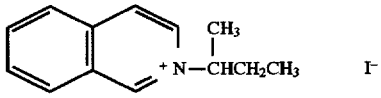
N-46
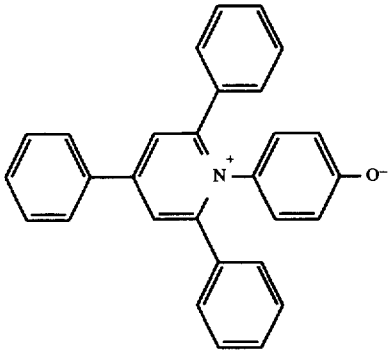
N-47
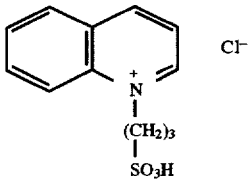
N-48
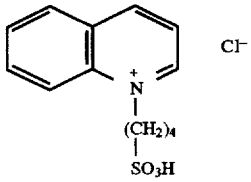
N-49
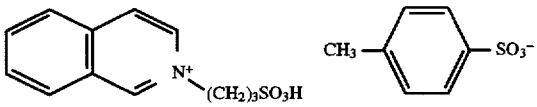
N-50
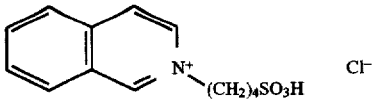

-continued
N-51
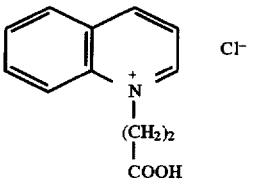
N-52
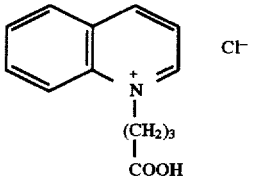
N-53
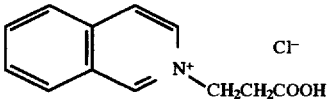
N-54
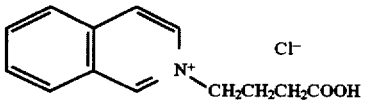
N-55
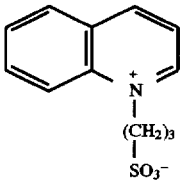
N-56
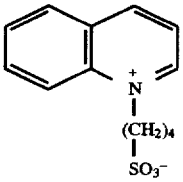
N-57
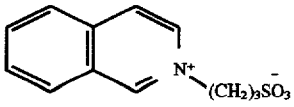
N-58
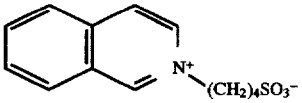
N-59
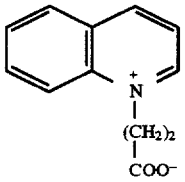
N-60
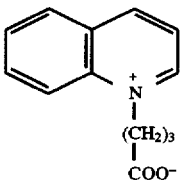
-continued
N-61
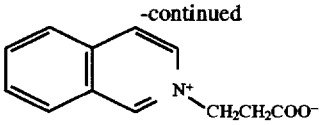
N-62
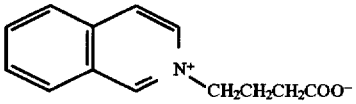
N-63
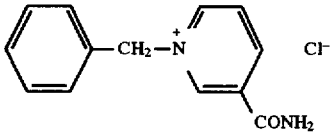
N-64
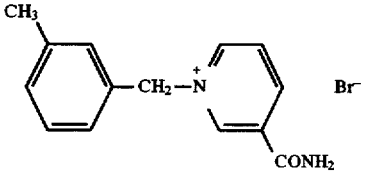
N-65
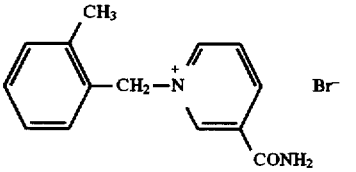
N-66
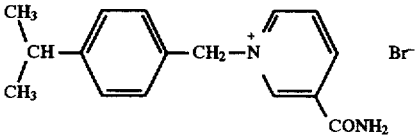
N-67
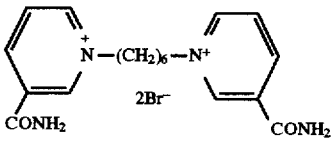
N-68
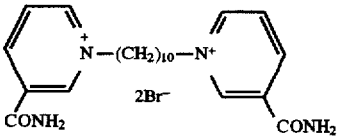
N-69
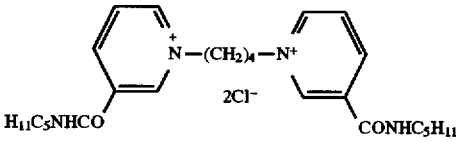
N-70
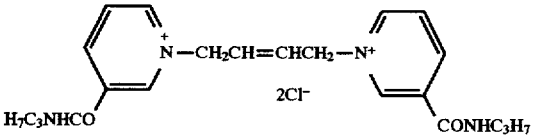
N-71
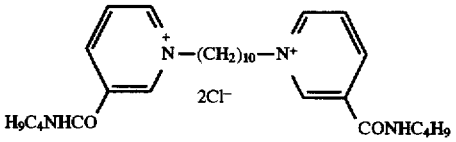

-continued

N-72

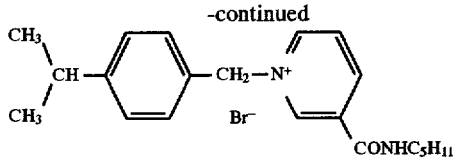

N-73

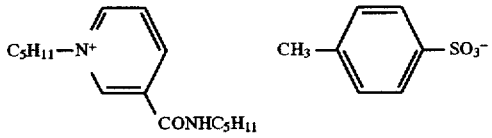

N-74

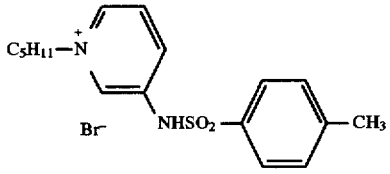

N-75

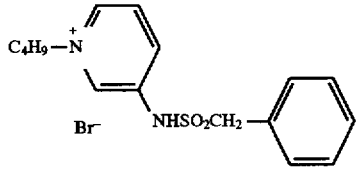

N-76

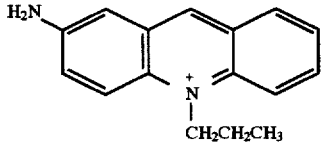

N-77

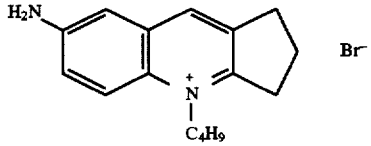

N-78

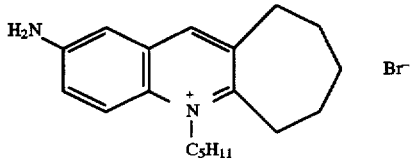

N-79

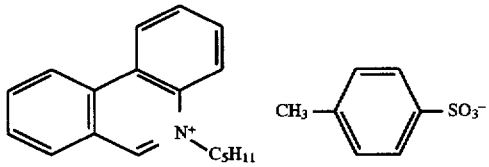

N-80

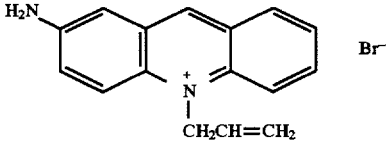

The pyridinium compound can be synthesized b through reaction of a corresponding pyridine, quinoline or isoquinoline derivative with an alkyl halide, as described in M. Odake, "Organic Chemistry" page 7 and 129 (1959, Asakura Shoten). Examples thereof are described in A. G. E. Renk, Helv. Chim. Acta 37, 1672 (1954); R. E. Lyle, E. F. Perlwski, H. J. Troscianec, G. G. Lyle, J. Chem. 20, 1761 (1955); M. R. Lamborg, R. M. Burton, N. O. Kaplan, J. Am. Chem. Soc. 79, 6173 (1957); W. Ciusa, A. buccelli, Gazzetta Chimia Italiana 88, 393 (1958).

The pyridinium compound may be incorporated in a silver halide emulsion layer or another light-insensitive hydrophilic colloidal layer, such as protective layer, interlayer, antihalation layer or filter layer. The pyridinium compound is incorporated in an amount of $1\times10^{-6}$ to 1 mol per mol of silver halide, preferably, $1\times10^{-4}$ to 0.1 mol per mol of silver halide. The pyridinium compound may be incorporated in combination thereof. The pyridinium compound is dissolved in water or water-miscible solvent such as alcohols, ketones, esters or amides. The pyridinium compound may be added in an emulsion layer or another light-insensitive layer at any time during the course of preparing a silver halide photographic material. For example, the addition to the emulsion may be made at a time from the start of chemical ripening to the time prior to coating.

A silver halide black-and-white photographic material used in the invention is preferably provided with a conductive layer on a support. The conductive layer can be formed by using a water soluble conductive polymer and hydrophobic polymeric hardener, or a metal oxide. The method thereof is described in JP-A 3-265842.

Silver halide usable in the invention may be any of silver bromide, silver iodobromide, silver iodochloride, silver bromochloride and silver chloride. Among these, silver bromochloride containing 50 mol % or more chloride and silver chloride. In the invention, monodispersed silver halide grain emulsion is preferred, having 15% or less of a variation coefficient expressed as (standard deviation of grain size distribution)/(average grain size)×100, which is determined from grain size measurement with electronmicrograph.

To the silver halide emulsion of the present invention, various technologies and additives known in the art can be used. For example, into the silver halide emulsion and backing layer(s), various chemical sensitizer, a toning agent, hardener, surfactant, thickener, plasticizer, sliding agent, development restrainer, UV absorber, anti-irradiation dye, heavy metal and matting agent can be contained by various means. In addition, a polymer latex can be contained in the silver halide emulsion and backing layer. These additives are described in detail in Research Disclosure Vol. 176, Item 17643 (December, 1978) and ibid Vol. 187, Item 18716 (November, 1979). The relevant portions are cited as below.

| Additive | RD/7643 | RD/8716 |
|---|---|---|
| 1. Chemical sensitizer | page 23 | page 648, right column |
| 2. Sensitivity increasing agent | page 23 | |
| 3. Spectral sensitizer, Super sensitizer | pages 23–24 | page 648, right column to page 649, right column |
| 4. Whitening agent | page 24 | |
| 5. Anti-foggant and stabilizer | page 24–25 | page 649 |
| 6. Light-absorbent, filter dye and UV absorber | page 25–26 | page 649–650, left column |
| 7. Anti-stain agent | page 25, right column | page 650, left column to right column |
| 8. Hardener | page 26 | page 651, left column |
| 9. Binder | page 26 | page 651, left column |
| 10. Plasticizer, lubricant | page 27 | page 650, right column |
| 11. Coating aid, surfactant | page 26–27 | page 650, right column |
| 12. Anti-static agent | page 27 | page 650, right column |

A support applicable in a silver halide photographic light sensitive material of the present invention includes polyester such as cellulose acetate, cellulose nitrate and polyethylene terephthalate, polyolefin such as polyethylene, polystyrene, baryta paper, polyolefin-coated paper, glass and metal. These support may be subbed.

EXAMPLES

The present invention is further explained with reference to examples; however, the scope of the invention is not limited to these examples.

Example 1

Preparation of Support

Synthesis of SPS

To toluene of 200 parts (by weight) was added styrene of 100 parts, together with triisobutyl aluminum and pentamethyl-cyclopentadienyltitanium trimethoxide and the mixture was subjected to reaction at 96° C. for a period of 8 hr. After removing the catalyst with sodium hydroxide, washing was made three time to obtain a final product, 34 parts, SPS (Syndiotactic polystyrene).

Preparation of SPS Film

Thus prepared SPS was extruded in the form of film through T-die at 330° C. and rapidly cooled down on a cooling drum to obtain unstretched film. The resulting film was previouly heated at 135° C., stretched in the longitudinal direction (3.1 times), further lateral-stretched at 130° C. (3.4 times) and then thermally fixed at 250° C. Resultingly, there was obtained a biaxial-stretched film with a thickness of 100 μm and beding elastic modulus of 450 kg/mm$^2$.

Subbing of SPS Film

A latex solution was coated on the SPS film and dried at 120° C. for 1 min. to form subbing layer with a thickness of 0.5 μm. The film was further subjected to corona-discharge at 0.5 kV·a·min/m$^2$. On the film, silica was deposited by vacuum evaporation and further thereon was coated styrene-glycidylacrylate and gelatin to form a adhesive layer.

Preparation of Silver Halide Photographic Material

Preparation of Silver Halide Emulsion A

Applying double jet precipitation, there were prepared silver bromochloride core grains having 70 mol % chloride content, average thickness of 0.05 μm and average diameter of 0.15 μm. $K_3RuCl_6$ of $8\times10^{-8}$ mol per mol of silver was added during the formation of the core grains. Shell was further formed on the core grain by double jet precipitation with adding $K_2IrCl_6$ of $3\times10^{-7}$ mol per mol of silver. The resulting emulsion was comprised of monodispersed, core/shell type, tabular silver iodobromochloride grains (Cl:90 mol %, I:0.2 mol %) having an average thickness of 0.10 μm, average diameter of 0.25 μm and variation coefficient of 10%. The emulsion was desalted using modified gelatin described in JP-A 2-280139 (e.g., G-8 exemplified therein, in which an amino group of gelatin was substituted by phenylcarbamoyl). After desalting, the EAg was 190 mV at 50° C.

To the emulsion was added 4-hydroxy-1,3,3a,7-tetrazaindene of $1\times10^{-3}$ mol per mol of silver and potassium bromide and citric acid were further added thereto to adjust the pH and EAg to 5.6 and 123 mV, respectively. Thereafter, the emulsion was chemical ripened at 60° C. by adding chloroauric acid of $1.2\times10^{-5}$ mol and elemental sulfur of $3\times10^{-6}$ mol. After completing chemical-ripening were added 4-hydroxy-1,3,3a,7-tetrazaindene of $2\times10^{-3}$ mol per mol of silver, 1-phenyl-5-mercaptotetrazole of $3\times10^{-4}$ mol and gelatin to obtain emulsion A.

Preparation of Emulsion B

Applying double jet precipitation, there were prepared silver bromochloride core grains containing 70 mol % chloride and 1.5 mol % iodide and having average thickness of 0.05 μm and average diameter of 0.15 μm. $K_3Rh(H_2O)Br_5$ of $2\times10^{-8}$ mol per mol of silver was added during the formation of the core grains. Shell was further formed on the core grain by double jet precipitation with adding $K_2IrCl_6$ of $3\times10^{-7}$ mol per mol of silver.

The resulting emulsion was comprised of monodispersed, core/shell type, tabular silver iodobromochloride grains (Cl:90 mol %, I:0.2 mol %) having an average thickness of 0.10 μm, average diameter of 0.42 μm and variation coefficient of 10%. The emulsion was desalted using modified gelatin described in JP-A 2-280139 (e.g., G-8 exemplified therein, in which an amino group of gelatin was substituted by phenylcarbamoyl). After desalting, the EAg was 180 mV at 50° C. To the emulsion was added 4-hydroxy-1,3,3a,7-tetrazaindene of $1\times10^{-3}$ mol per mol of silver and potassium bromide and citric acid were further added thereto to adjust the pH and EAg to 5.6 and 123 mV, respectively. Thereafter, the emulsion was chemical ripened at 60° C. by adding chloroauric acid of $1.2\times10^{-5}$ mol and N,N,N'-trimethyl-N'-heptafluoroselenourea of $3\times10^{-5}$ mol. After completing chemical-ripening were added 4-hydroxy-1,3,3a,7-tetrazaindene of $2\times10^{-3}$ mol per mol of silver, 1-phenyl-5-mercaptotetrazole of $3\times10^{-4}$ mol and gelatin to obtain emulsion B.

Preparation of Silver Halide Photographic Material For Use in Print-Making Scanner With He—Ne Laser Light Source On one side of the subbed support above-described were simultaneouly coated a gelatin subbing layer of formula 1 with a gelatin coating amount of 0.5 g/m$^2$, a silver halide emulsion layer (1) of formula 2 with a silver coating amount of 2.9 g/m$^2$, a interlayer of formula 3 with a gelatin coating amount of 0.3 g/m$^2$, a silver halide emulsion layer (2) of formula 4 with a silver coating amount of 0.2 g m$^2$ and a protective layer of formula 5 with a gelatin coating amount of 0.6 g/m$^2$, in this order from the support.

On the opposite side of the support were coated a backing layer of formula 6 with a gelatin coating amount of 0.6 g/m$^2$, a hydrophobic polymer layer of formula 7 and further thereon a backing protective layer of formula 8 with a gelatin coating amount of 0.4 g/m$^2$ at the same time with the emulsion-side.

| Formula 1 (Gelatin sublayer) | |
|---|---|
| Gelatin | 0.5 g/m$^2$ |
| Dye AD-1, solid particle dispersion (average particle size, 0.1 μm) | 25 mg/m$^2$ |
| Sodium polystyrenesulfonate (average molecular weight, 500000) | 10 mg/m$^2$ |
| S-1 (Sodium isoamyl-n-decylsulfosuccinate) | 0.4 mg/m$^2$ |
| **Formula 2 (Silver halide emulsion layer-1)** | |
| Silver halide emulsion A | 1.5 g/m$^2$ |

-continued

| | |
|---|---|
| | (silver equivalent amount) |
| Dye AD-8, solid particle dispersion (average particle size, 0.1 μm) | 20 mg/m$^2$ |
| Cyclodextrin (hydrophilic polymer) | 0.5 g/m$^2$ |
| Sensitizing dye d-1 | 5 mg/m$^2$ |
| Sensitizing dye d-2 | 5 mg/m$^2$ |
| Hydrazine compound H-7 | 20 mg/m$^2$ |
| Redox compound RE-1 | 20 mg/m$^2$ |
| Compound e | 100 mg/m$^2$ |
| Latex polymer f | 0.5 mg/m$^2$ |
| Hardener g | 5 mg/m$^2$ |
| S-1 | 0.7 mg/m$^2$ |
| 2-mercapto-6-hydroxypurine | 5 mg/m$^2$ |
| Sodium ethylenediaminetetraacetate | 30 mg/m$^2$ |
| Colloidal silica (average particle size, 0.05 μm) | 10 mg/m$^2$ |
| Formula 3 (Interlayer) | |
| Gelatin | 0.3 g/m$^2$ |
| S-1 | 2 mg/m$^2$ |
| Formula 4 (Silver halide emulsion layer) | |
| Silver halide emulsion B | 1.4 g/m$^2$ |
| | (silver equivalent amount) |
| Sensitizing dye d-1 | 0.5 mg/m$^2$ |
| Sensitizing dye d-2 | 3 mg/m$^2$ |
| Hydrazine compound H-20 | 20 mg/m$^2$ |
| Nucleation accelerating agent Nb-12 | 40 mg/m$^2$ |
| Redox compound RE-2 | 20 mg/m$^2$ |
| Latex polymer f | 0.5 mg/m$^2$ |
| S-1 | 1.7 mg/m$^2$ |
| 2-mercapto-6-hydroxypurine | 5 mg/m$^2$ |
| Sodium ethylenediaminetetraacetate | 20 mg/m$^2$ |
| Formula 5 (Protective layer) | |
| Gelatin | 0.6 g/m$^2$ |
| Dye AD-5, solid particle dispersion (average particle size, 0.1 μm) | 40 mg/m$^2$ |
| S-1 | 12 mg/m$^2$ |
| Matting agent (monodispersed silica particles with average size, 3.5 μm) | 25 mg/m$^2$ |
| Nucleation accelerating agent Na-3 | 40 mg/m$^2$ |
| 1,3-Vinylsulfonyl-2-propanol | 40 mg/m$^2$ |
| Surfactant h | 1 mg/m$^2$ |
| Colloidal silica (average particle size, 0.05 μm) | 10 mg/m$^2$ |
| Hardener K-1 | 30 mg/m$^2$ |
| Formula 6 (Backing layer) | |
| Gelatin | 0.6 g/m$^2$ |
| S-1 | 5 mg/m$^2$ |
| Latex polymer f | 0.3 g/m$^2$ |
| Colloidal silica (average particle size, 0.05 μm) | 70 mg/m$^2$ |
| Sodium polystyrenesulfonate | 20 mg/m$^2$ |
| Compound i | 100 mg/m$^2$ |
| Formula 7 (Hydrophobic polymer layer) | |
| Latex (methyl methaacrylate:acrylic acid-97:3) | 1.0 mg/m$^2$ |
| Hardener g | 6 mg/m$^2$ |
| Formula 8 (Backing layer) | |
| Gelatin | 0.4 mg/m$^2$ |
| Matting agent (polymethyl methaacrylate monodispersed particles with av. size of 5 μm) | 50 mg/m$^2$ |
| Sodium di-(2-ethylhexyl)-sulfosuccinate | 10 mg/m$^2$ |
| Surfactant h | 1 mg/$^2$ |
| Dye k | 20 mg/m$^2$ |
| $H-(OCH_2CH_2)_{68}-OH$ | 50 mg/m$^2$ |
| Hardener K-1 | 20 mg/m$^2$ |

Compound i

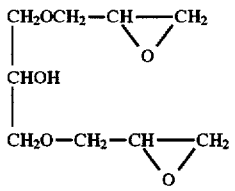

-continued
Dye k
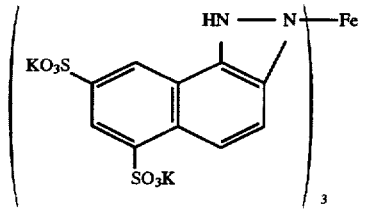
K-1
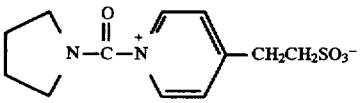
Sensitizing dye d-1
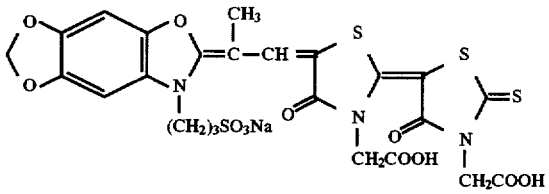
Sensitizing dye d-2
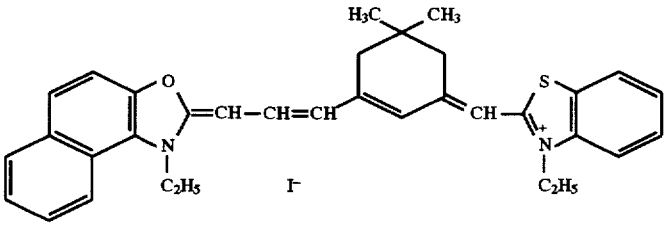
Compound e
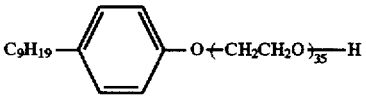
Latex polymer f
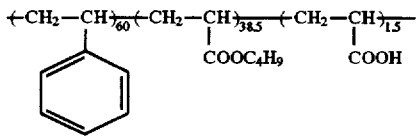
Hardener g
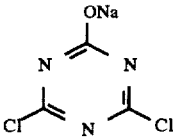
Surfactant h
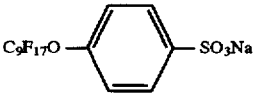
AD-1

-continued

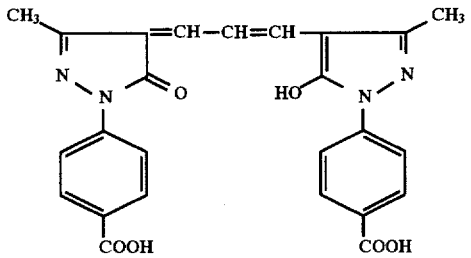

AD-5

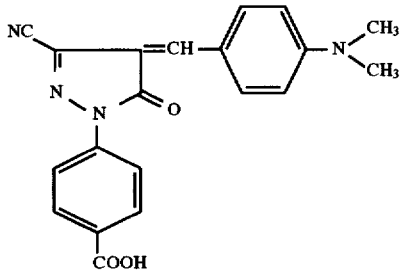

AD-8

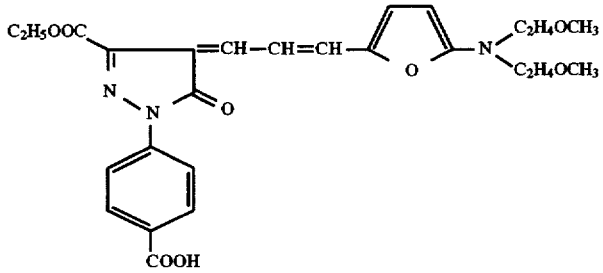

After being dried, the surface specific resistance of backing-side of the photographic material was proved to be $5\times10^{11}$ at 23° C. and 20% RH. The pH of the surface layer of the emulsion-side was 5.6.

| Processing solution formula Developer (HAD-S): (for working solution of 1 liter) | |
|---|---|
| Water | 400 ml |
| Pentasodium diethylenetriaminepentaacetate | 1.45 g |
| Sodium sulfite | 31.52 g |
| Potassium carbonate | 155 g |
| 8-Mercaptoadenine | 0.06 g |
| Diethylene glycol | 50 g |
| 5-Methylbenzotrizole | 0.27 g |
| 1-Phenyl-5-mercaptotetrazole | 0.03 g |
| 1-Phenyl-4-hydroxymethyl-4-methyl-3-pyrazolidone (Dimezone S) | 1.1 g |
| Exemplified A-18 (sodium erythorbate) | 38 g |
| Diethylaminopropane-diol | 25 g |
| Maltosylcyclodextrin | 20 g |

Using KOH (55% aqueous solution) and water, the total amount was made to 500 ml. Water of 500 ml and the above solution of 500 ml were mixed to make a working solution of 1 liter.

Preparation of Developer-Replenishing Composition in the Form of Tablet (HAD-JR)

| Preparation of granular Part A (corresponding to working solution of 1 liter) | |
|---|---|
| Pentasodium diethylenetriaminepentaacetate | 1.45 g |
| Sodium sulfite | 31.52 g |
| 8-Mercaptoadenine | 0.06 g |
| 5-Methylbenzotrizole | 0.27 g |
| 1-Phenyl-5-mercaptotetrazole | 0.03 g |
| 1-Phenyl-4-hydroxymethyl-4-methyl-3-pyrazolidone (Dimezone S) | 1.1 g |
| Exemplified A-18 (sodium erythorbate) | 38 g |
| Maltosylcyclodextrin in an amount as shown in Table 1 | |
| Pineflow (product by Matsugaya Kagaku) | 4 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part A

| Preparation of granular Part B (corresponding to working solution of 1 liter) | |
|---|---|
| Potassium carbonate | 155 g |
| D-mannitol (product by Kao) | 5 g |
| Lithium hydroxide | 3 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules. Part B Parts A and B were completely mixed over a period of 10 min. and the mixture was tabletted using tabletting machine. Machina UD.DFE30.40 produced by Machina Co., at a tabletting pressure of 1.5 tons/m$^2$ to prepare 25 tablets with a diameter of 30 mm and thickness of 10 mm.

Preparation of Developer Replenishing Solution

Thus prepared 25 tablets were dissolved in water of 1000 ml at 25° C. to prepare a developer replenishing solution, the pH of which was 10.40.

| Comparative developer replenishing solution (HAD-SR) (for working solution of 1 liter) | |
|---|---|
| Water | 400 ml |
| Pentasodium diethylenetriaminepentaacetate | 1.45 g |
| Sodium sulfite | 31.52 g |
| Potassium carbonate | 155 g |
| 8-Mercaptoadenine | 0.06 g |
| 5-Methylbenzotrizole | 0.27 g |
| 1-Phenyl-5-mercaptotetrazole | 0.03 g |
| 1-Phenyl-4-hydroxymethyl-4-methyl-3-pyrazolidone (Dimezone S) | 1.1 g |
| Exemplified A-18 (sodium erythorbate) Cyclodextrin compound in an amount as shown in Table 1 | 38 g |
| Pineflow (product by Matsugaya Kagaku) | 4 g |
| D-mannitol (product by Kao) | 5 g |
| Lithium hydroxide | 3 g |

Water was added to make the total amount of 500 ml (pH 10.45). Water of 500 ml and the above solution of 500 ml were mixed to make 1 liter of a developer-replenishing solution. The pH of the replenishing solution was 10.4.

| Fixer (HAF-S): (for working solution of 1 liter) | |
|---|---|
| Water | 120 ml |
| Ammonium thiosulfate (10% Na salt, product by Hoechst) | 140 g |
| Sodium sulfite | 22 g |
| Boric acid | 10 g |
| Tartaric acid | 3 g |
| Sodium acetate trihydride | 37.8 g |
| Acetic acid (90% aq. solution) | 13.5 g |
| Aluminum sulfate octadecahydride | 18 g |
| Maltosyldextrin | 5 g |

Water was added to make the total amount of 500 ml (pH 4.83). Water of 500 ml and the above solution of 500 ml were mixed to make 1 liter of a Fixer-working solution.

Preparation of Fixer-Replenishing Composition in the Form of Tablet

| Preparation of granular Part A (corresponding to working solution of 1 liter) | |
|---|---|
| Ammonium thiosulfate (10% Na salt, product by Hoechst) | 140 g |
| Sodium bisulfite | 10 g |
| Sodium acetate | 40 g |
| Maltosyldextrin | 5 g |
| Pineflow (product by Matsugaya Kagaku) | 8 g |

Above materails were mixed over a period of 30 min. by a commercially available mill and granulated at room temperature over a period of 10 min. using a commercially available granulating machine. The resulting granules were dried at 40° C. over a period of 2 hr by a fluidized bed type drying machine to obtain granules of Part A.

| Preparation of granular Part B (corresponding to working solution of 1 liter) | |
|---|---|
| Boric acid | 10 g |
| Tartaric acid | 3 g |
| Sodium hydrogensulfate | 18 g |
| Aluminum sulfate octadecahydrate | 37 g |
| Pineflow (product by Matsugaya Kagaku) | 4 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules of Part B.

Parts A and B were completely mixed over a period of 10 min. and the mixture was tabletted using tabletting machine. Machina UD.DFE30.40 produced by Machina Co., at a tabletting pressure of 1.5 tons/m$^2$ to prepare 25 tablets with a diameter of 30 mm and thickness of 10 mm.

Preparation of Fixer-Replenishing Solution

Thus prepared 25 tablets were dissolved in water at 25° C. to make a fixer-replenishing solution of 1000 ml. The pH was 4.20.

An automatic processor GR-26 (product by Konica Corp.) was employed. The replenishing rate of the developer or fixer replenishing solution was 40 ml per sheet of large full size (610×508 mm). In cases where the tablet was directly replenished, the processor was modified so that the tablet was supplied from the upper portion. A developer replenishing tablet and water of 40 ml, or a fixer replenishing tablet and water of 40 ml each were supplied.

Processing Condition

| Step | Temperature | Time |
|---|---|---|
| Developing | 35° C. | 30 sec. |
| Fixing | 34° C. | 20 sec. |
| Washing | Ordinary temp. | 20 sec. |
| Drying | 45° C. | 20 sec. |
| Line-speed (conveying speed): 984 mm/min. | | |

Evaluation

The photographic material, a half portion of which was light-exposed was processed using a fresh solution or running solution as a developer and evaluated with respect to sensitivity, gamma (γ) and dot quality. As the running solution was used a developer solution after 1000 sheets of the photographic material was processed.

Sensitivity (S)

Instead of exposure to He—Ne laser, the photographic material was exposed through 633 nm interference filter for $10^{-6}$ sec. and processed. Sensitometry was made with a densitometer PDA-65 (product by Konica). The sensitivity was shown as a relative value, based on the sensitivity at a density of 2.5 of the photographic material processed with the fresh solution being 100.

Gamma (γ)

Gamma is a gradation, defined as a tangent between densities of 0.1 and 3.0 (in other words, a slope of a line connecting two points corresponding densities of 0.1 and 3.0). In case of a γ-value of less than 6, the processing is impractical and even in case of not less than 6 and less than 10, it is insufficient contrast. The γ value of not less than 10 produces a super high contrast image which is sufficient for practical use.

Dot Quality (DQ)

The photographic material was exposed through a random-patterned halftone screen with 16 μm dot (FM screen) using SG-747RU (product by Dainippon Screen Co.) and processed to form halftone dot image. Medium dots (aimed at 50% dot) were visually evaluated, using 100 times magnifier, with respect to dot quality based on five grades of 5 (the best level) and 4, 3, 2, and 1 (the worst) along with deterioration of the dot quality. Grades of not more than 2 are outside of practical use.

5: The boundary between the dot and surrounding unexposed portion is clear.

4: Intermediate between 5 and the following 3.

3: The boundary between the dot and surrounding unexposed portion is slightly unsharp but dots are not deformed.

2: The boundary between the dot and surrounding unexposed portion is unsharp and a part of dots is deformed.

1: The boundary between the dot and surrounding unexposed portion is unsharp and dots are deformed.

Results thereof are shown in Table 1.

TABLE 1

| Exp. No. | Replenisher | Developimg agent (g/l) | Cyclodex-trin (g/l) | Restrainer (mg/l) | Fresh S | Fresh γ | Fresh DQ | Running S | Running γ | Running DQ | Remarks |
|---|---|---|---|---|---|---|---|---|---|---|---|
| 1 | HAD-SR (Liquid) | A-18 (38) | D-5 (10) | A•B* (270•60) | 100 | 11.9 | 4 | 70 | 9.5 | 2.0 | Comp. |
| 2 | HAD-JR (Liquid) | A-18 (38) | — — | A•B (270•60) | 100 | 11.9 | 4 | 80 | 10.2 | 3.0 | Comp. |
| 3 | HAD-JR (Liquid) | A-18 (38) | D-5 (10) | A•B (270•60) | 100 | 11.9 | 4 | 96 | 11.5 | 4.0 | Inv. |
| 4 | HAD-JR (Liquid) | A-18 (38) | D-5 (30) | A•B (270•60) | 100 | 11.9 | 4 | 97 | 11.6 | 4.0 | Inv. |
| 5 | HAD-JR (Solid) | A-18 (38) | — — | A•B (270•60) | 100 | 11.9 | 4 | 84 | 10.6 | 3.0 | Comp. |
| 6 | HAD-JR (Solid) | A-18 (38) | D-5 (10) | A•B (270•60) | 100 | 11.9 | 4 | 101 | 12.0 | 5.0 | Inv. |
| 7 | HAD-JR (Solid) | A-18 (38) | D-5 (30) | A•B (270•60) | 100 | 11.9 | 4 | 100 | 12.4 | 5.0 | Inv. |
| 8 | HAD-JR (Solid) | A-18 (38) | D-14 (30) | A•B (270•60) | 100 | 11.9 | 4 | 101 | 12.1 | 5.0 | Inv. |
| 9 | HAD-JR (Liquid) | A-18 (38) | D-5 (30) | A 300 | 100 | 11.9 | 4 | 102 | 12.1 | 5.0 | Inv. |
| 10 | HAD-JR (Liquid) | A-18 (38) | — — | A 300 | 100 | 11.9 | 4 | 76 | 10.0 | 2.0 | Comp. |
| 11 | HAD-JR (Liquid) | A-18 (38) | D-5 (30) | — — | 100 | 11.9 | 4 | 75 | 9.5 | 2.0 | Comp. |
| 12 | HAD-JR (Solid) | A-18 (38) | D-5 (30) | B 100 | 100 | 11.9 | 4 | 110 | 11.5 | 4.5 | Inv. |
| 13 | HAD-JR (Solid) | A-18 (38) | — —0 | B 100 | 100 | 11.9 | 4 | 76 | 9.4 | 2.0 | Comp. |
| 14 | HAD-JR (Solid) | A-18 (38) | D-5 (30) | — — | 100 | 11.9 | 4 | 78 | 8.2 | 2.0 | Inv. |

*A: 5-mercaptobenzotriazole
B: 1-phenyl-5-mercaptotetrazole

Example 2

Preparation of Photographic Material

Preparation of Silver Halide Emulsion

There was prepared a monodispersed silver bromochloride cubic grain emulsion having a chloride content of 98 mol % and an average grain size of 0.15 μm. During the course of grain formation was added $K_3Rh(H_2O)Br_5$ of $7\times19^{-5}$ mol per mol of silver. Further, prior to desalting was added 4-hydroxy-6-hydroxy-1,3,3a,7-tetraazaindene of 0.6 g per mol of silver (hereinafter, unless otherwise described, the amount per mol of silver).

The emulsion was heated to 60° C. and then 4-hydroxy-6-hydroxy-1,3,3a,7-tetraazaindene of 60 mg, sodium thiosulfate of 0.75 mg were added thereto. After 60 min., 4-hydroxy-6-hydroxy-1,3,3a,7-tetraazaindene of 600 mg was further added and the emulsion was cooled to be set The resulting silver halide emulsion was referred to as emulsion C.

The following layers were coated on a support in a coating amount as shown below.

Emulsion Layer

| | |
|---|---|
| Silver halide emulsion C | 4.0 g/m$^2$ |
| Gelatin | 0.53 g/m$^2$ |
| NaOH | 88 mg/m$^2$ |
| Compound (a) | 6.53 mg/m$^2$ |
| Tetrazolium compound (T-7) | 40 mg/m$^2$ |
| Saponin | 107 mg/m$^2$ |
| Compound (b) | 18.5 mg/m$^2$ |
| Compound (c) | 9.8 mg/m$^2$ |
| Gelatin latex | 480 mg/m$^2$ |
| Polystyrenesulfonate sodium salt | 52.2 mg/m$^2$ |
| Lower protective layer: | |
| Gelatin | 0.5 g/m$^2$ |
| Compound (d) | 62.0 mg/m$^2$ |
| Citric acid | 4.1 mg/m$^2$ |
| Formalin | 1.7 mg/m$^2$ |
| Polystyrenesulfonate sodium salt | 11.0 mg/m$^2$ |
| Upper protective layer: | |
| Gelatin | 0.3 g/m$^2$ |
| Compound (e) | 18.0 mg/m$^2$ |
| Compound (d) | 48.4 mg/m$^2$ |
| Compound (f) | 105.0 mg/m$^2$ |
| Compound (g) | 1.25 mg/m$^2$ |
| Amorphous silica (av. size: 1.63 μm) | 15.0 mg/m$^2$ |
| Amorphous silica (av. size: 3.5 μm) | 21.0 mg/m$^2$ |
| Citric acid | 4.5 mg/m$^2$ |
| Polystyrenesulfonate sodium salt | 11.0 mg/m$^2$ |
| Formalin | 10 mg/m$^2$ |
| Backing layer | |
| Compound (h) | 170 mg/m$^2$ |
| Compound (d) | 30 mg/m$^2$ |
| Compound (i) | 45 mg/m$^2$ |
| Compound (j) | 10 mg/m$^2$ |
| Saponin | 111 mg/m$^2$ |
| Compound (k) | 200 mg/m$^2$ |
| Colloidal silica | 200 mg/m$^2$ |
| Compound (l) | 35 mg/m$^2$ |
| Compound (m) | 31 mg/m$^2$ |
| Compound (n) | 3.1 mg/m$^2$ |
| Polymethy methacrylate (av. size: 5.6 μm) | 28.9 mg/m$^2$ |
| Glyoxal | 10.1 mg/m$^2$ |
| Citric acid | 9.3 mg/m$^2$ |
| Polystyrenesulfonate sodium salt | 71.1 mg/m$^2$ |
| Compound (o) | 81 mg/m$^2$ |
| Compound (p) | 88.2 mg/m$^2$ |
| Calcium acetate | 3.0 mg/m$^2$ |
| Formalin | 10 mg/m$^2$ |

Compound a

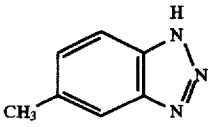

Compound b

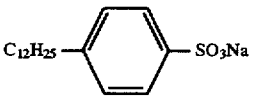

Compound c

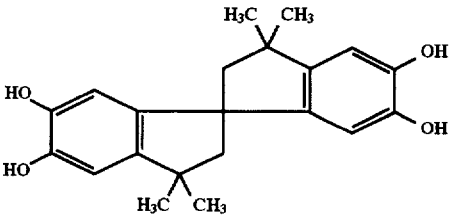

-continued
Compound d
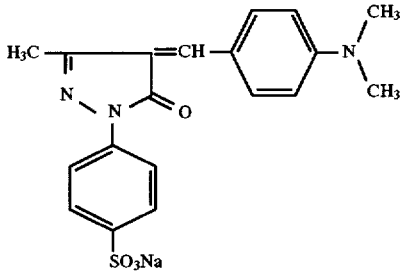
Compound e $NaO_3S-CHCOOCH_2CH(C_2H_5)C_4H_9$
$CH_2COOCH_2CH(C_2H_5)C_4H_9$
Compound f
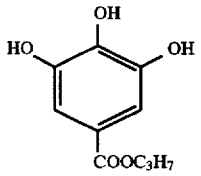
Compound g
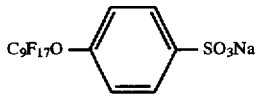
Compound h
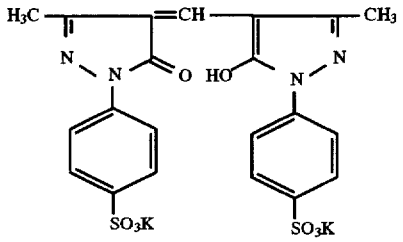
Compound i
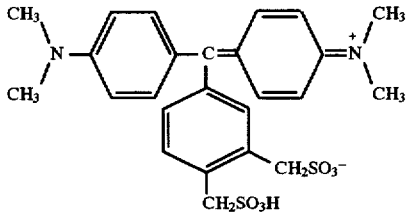
Compound j $NaO_3S-CHCOO(CH_2)_9CH_3$
$CH_2COO(CH_2)_2-CH(CH_3)_2$
Compound k
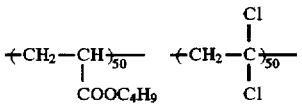
Compound l $H(OCH_2CH_2)_nOH$ n = 34.6
Compound m
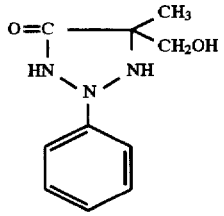
Compound n $HOCH_2SO_3Na$ -continued Compound o $CH_2$—CH—$CH_2OCH_2CH_2OCH_2$—CH—$CH_2$ (O)

Compound p $(CH_2{=}CHSO_2CH_2)_4C$

Gelatin latex

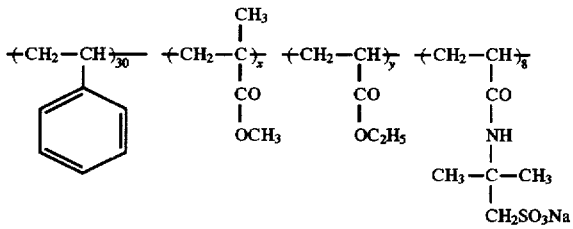

Gelation latex = 5:1 x + y = 62

| Processing solution formula Developer (TAD-S): (used for working solution of 1 liter) | |
|---|---|
| Water | 400 ml |
| Pentasodium diethylenetriaminepentaacetate | 1.45 g |
| Sodium sulfite | 18 g |
| Potassium carbonate | 120 g |
| 8-Mercaptoadenine | 0.06 g |
| Diethylene glycol | 50 g |
| 5-Methylbenzotrizole | 0.55 g |
| 1-Phenyl-5-mercaptotetrazole | 0.02 g |
| 1-Phenyl-4-hydroxymethyl-4-methyl-3-pyrazolidone (Dimezone S) | 1.4 g |
| Sodium erythorbate | 38 g |
| Isoelite P (Ensuiko Seito) | 20 g |

Using KOH (55% aqueous solution) and water, the total amount was made to 500 ml. Water of 500 ml and the above solution of 500 ml wee mixed to make a working solution of 1 liter.

Preparation of Developer-Replenishing Composition in the Form of Tablet (TAD-JR)

| Preparation of granular Part A (used for working solution of 1 liter) | |
|---|---|
| Pentasodium diethylenetriaminepentaacetate | 1.45 g |
| Sodium sulfite | 20.15 g |
| Potassium carbonate | 155 g |
| 8-Mercaptoadenine | 0.06 g |
| 5-Methylbenzotrizole | 0.55 g |
| 1-Phenyl-5-mercaptotetrazole | 0.02 g |
| 1-Phenyl-4-hydroxymethyl-4-methyl-3-pyrazolidone (Dimezone S) | 1.4 g |
| Sodium erythorbate | 38 g |
| Cyclodextrin compound in an amount as shown in Table 1 | |
| Pineflow (product by Matsugaya Kagaku) | 4 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part A

| Preparation of granular Part B (used for working solution of 1 liter) | |
|---|---|
| Potassium carbonate | 120 g |
| D-mannitol (product by Kao) | 5 g |
| Lithium hydroxide | 3 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part B Parts A and B were completely mixed over a period of 10 min. and the mixture was tabletted using tabletting machine, Machina UD.DFE30.40 produced by Machina Co., at a tabletting pressure of 1.5 tons/$m^2$ to prepare 25 tablets with a diameter of 30 mm and thickness of 10 mm.

| Comparative developer replenishing solution (TAD-SR) (used for working solution of 1 liter) | |
|---|---|
| Water | 400 ml |
| Pentasodium diethylenetriaminepentaacetate | 1.45 g |
| Sodium sulfite | 20.15 g |
| Potassium carbonate | 120 g |
| 8-Mercaptoadenine | 0.06 g |
| 5-Methylbenzotrizole | 0.55 g |
| 1-Phenyl-5-mercaptotetrazole | 0.02 g |
| 1-Phenyl-4-hydroxymethyl-4-methyl-3-pyrazolidone (Dimezone S) | 1.4 g |
| Sodium erythorbate | 38 g |
| Cyclodextrin compound in an amount as shown in Table 2 | |
| Pineflow (product by Matsugaya Kagaku) | 4 g |
| D-mannitol (product by Kao) | 5 g |
| Lithium hydroxide | 3 g |

Water was added to make the total amount of 500 ml (pH 10.45). Water of 500 ml and the above solution of 500 ml were mixed to make 1 liter of a developer-replenishing solution. The pH of the replenishing solution was 10.4.

The same fixer as in Example 1 was used.

An automatic processor GR-26SR (product by Konica Corp.) was employed. The replenishing rate of the developer or fixer replenishing solution was 40 ml per sheet of large full size (610×508 mm). In cases where the tablet was directly replenished, the processor was modified so that the tablet was supplied from the upper portion. A developer replenishing tablet and water of 40 ml, or a fixer replenishing tablet and water of 40 ml each were supplied.

Processing Condition

| Step | Temperature | Time |
|---|---|---|
| Developing | 35° C. | 15 sec. |
| Fixing | 34° C. | 10 sec. |
| Washing | Ordinary temp. | 10 sec. |
| Drying | 45° C. | 10 sec. |
| Line-speed (conveying speed): 1968 mm/min. | | |

Evaluation

25 Tablets of the developer replenishing composition were dissolved in water of 500 ml at 25° C. to prepare a concentrated developer-replenishing solution. After keeping this concentrated solution or the tablets at 50° C. for 3 days in a sealed vessel made of polyethylene terephthalate (oxygen permeability: 45 ml/atm·m$^2$·25·day), they each were used as a replenisher in the form of a solution or tablet.

A portion of 20% of the total area of the photographic material was exposed and processed using a fresh solution or running solution as a developer. As the running solution was used a developer solution after 1000 sheets of the photographic material was processed. The photographic material was evaluated with respect to reverse text quality. Evaluation of reverse text quality (RTQ) and Gamma (γ):

A photographic material sample was imagewise exposed through a transparent original in contact with the emulsion side of the photographic material by means of a roomlight-handlable printer '627FM which was provided with a light source of a non-electrode type discharge tube produced by Fusion of USA, and the processed sample was evaluated with respect to reverse text quality, based on five grades. Grade, 5 of the reverse text quality is such quality that, when exposed through halftone dots having a dot percentage of 50%, in an exposure amount that forms dots having a dot percentage of 50%, a character with 30 μm width is reproduced, therefore, it is very excellent in reverse text quality. Grade, 1 is such quality that, when exposed similarly, only character with 150 μm width is reproduced, therefore, it is poor in reverse text quality. Grades of 3 or more are levels sufficient for practical use.

The gamma (γ) is defined as below, $$\gamma=(1.0-0.1)/\{\log(\text{exposure giving a density of 1.0})-\log(\text{Exposure giving a density of 0.1})\}$$

Thus, the gamma is a gradation, defined as a tangent between densities of 0.1 and 1.0 (alternatively, a slope of a line connecting two points corresponding densities of 0.1 and 3.0). In case of a γ-value of less than 6, the processing is impractical and even in case of not less than 6 and less than 10, it is insufficient contrast. The γ value of not less than 10 produces a super high contrast image which is sufficient for practical use.

TABLE 2

| Exp. No. | Replenisher | Developimg agent(g/l) | Cyclodex-trin(g/l) | Restrainer (mg/l) | Fresh γ | Fresh RTQ | Running γ | Running RTQ | Re-marks |
|---|---|---|---|---|---|---|---|---|---|
| 1 | HAD-SR(Liquid) | A-18(38) | D-5(10) | A · B*(550 · 20) | 11.5 | 4 | 9.3 | 2 | Comp. |
| 2 | HAD-JR(Liquid) | A-18(38) | — — | A · B(550 · 20) | 11.5 | 4 | 10.1 | 3 | Comp. |
| 3 | HAD-JR(Liquid) | A-18(38) | D-5(10) | A · B(550 · 20) | 11.5 | 4 | 11.2 | 4 | Inv. |
| 4 | HAD-JR(Liquid) | A-18(38) | D-5(30) | A · B(550 · 20) | 11.5 | 4 | 11.3 | 4 | Inv. |
| 5 | HAD-JR(Solid) | A-18(38) | — — | A · B(550 · 20) | 11.5 | 4 | 10.3 | 3 | Comp. |
| 6 | HAD-JR(Solid) | A-18(38) | D-5(10) | A · B(550 · 20) | 11.5 | 4 | 11.6 | 5 | Inv. |
| 7 | HAD-JR(Solid) | A-18(38) | D-5(30) | A · B(550 · 20) | 11.5 | 4 | 11.6 | 5 | Inv. |
| 8 | HAD-JR(Solid) | A-18(38) | D-14(30) | A · B(550 · 20) | 11.5 | 4 | 11.5 | 5 | Inv. |
| 9 | HAD-JR(Liquid) | A-18(38) | D-5(30) | A 550 | 11.5 | 4 | 11.3 | 5 | Inv. |
| 10 | HAD-JR(Liquid) | A-18(38) | — (30) | A 550 | 11.5 | 4 | 9.6 | 2 | Comp. |
| 11 | HAD-JR(Liquid) | A-18(38) | D-5(30) | — — | 11.5 | 4 | 9.9 | 3 | Comp. |

*A: 5-mercaptobenzotriazole
B: 1-phenyl-5-mercaptotetrazole

Example 3

Preparation of Silver Halide Emulsion D

A silver bromochloride emulsion was prepare by mixing a silver nitrate solution and a solution of NaCl and KBr by double jet precipitation. During the precipitation, the mixture was maintained at 36° C., a pAg of 7.8 and a pH of 3.0 and $K_3RuCl_6$ of $8\times10^{-8}$ mol per mol of silver and $K_2IrCl_6$ of $3\times10^{-7}$ mol per mol of silver were added. Thereafter, the emulsion was desalted with phenylisocyanate-modified gelatin and then ossein gelatin was further added. The resulting emulsion was comprised of cubic silver bromochloride grains (Cl:80 mol %) with an average size of 0.18 μm and a variation coefficient of grain size of 10%.

To the thus prepared emulsion was added 4-hydroxy-6-methyl-1,3,3a,7-tetrazaindene of $1\times10^{-3}$ mol per mol of silver and after adjusting the pH and EAg, respectively, to 5.6 and 123 mV with potassium bromide and citric acid, the emulsion was chemically ripened at 60° C. by adding chloroauric acid of $2\times10^{-5}$ mol per mol of silver and N,N,N'-trimethyl-N'-heptafluoroselenourea of $2\times10^{-6}$ mol per mol of silver. After completion of chemical ripening, 4-hydroxy-6-methyl-1,3,3a,7-tetrazaindene of $3\times10^{-3}$ mol per mol of silver was added.

Preparation of Silver Halide Photographic Material for Use in Print-making Scanner With He—Ne Laser Light Source On one side of the subbed support above-described were simultaneouly coated a gelatin subbing layer of formula 1 with a gelatin coating amount of 1.0 g/m$^2$, a silver halide emulsion layer of formula 2 with a silver coating amount of 3.5 g/m$^2$ and gelatin coating amount of 1.5 g/m$^2$, and a protective layer of formula 3 with a gelatin coating amount of 0.6 g/m$^2$, in this order from the support. On the opposite side of the support were coated a backing layer of formula 4 with a gelatin coating amount of 2.0 g/m$^2$ and further thereon a backing protective layer of formula 5 with a gelatin coating amount of 1.0 g/m² at the same time with the emulsion-side.

| Formula 1 (Gelatin sublayer) | |
|---|---|
| Gelatin | 1.0 g/m² |
| 1-Phenyl-5-mercaptotetrazole | 1 mg/m² |
| Sodium polystyrenesulfonate | 10 mg/m² |
| S-1 (Sodium isoamyl-n-decylsulfosuccinate) | 0.4 mg/m² |
| **Formula 2 (Silver halide emulsion layer-1)** | |
| Silver halide emulsion D (silver equivalent amount) | 3.5 g/m² |
| Sensitizing dye d-1 | 3 mg/m² |
| Sensitizing dye d-2 | 3 mg/m² |
| Pyridinium compound (N-25) | 52.5 mg/m² |
| Compound e | 100 mg/m² |
| Latex polymer f | 0.5 mg/m² |
| Hardener g | 5 mg/m² |
| S-1 | 0.7 mg/m² |
| 2-mercapto-6-hydroxypurine | 5 mg/m² |
| Styrene-maleic acid copolymer (thickener) | 15 mg/m² |
| Sodium ethylenediaminetetraacetate | 30 mg/m² |
| **Formula 3 (Protective layer)** | |
| Gelatin | 0.6 g/m² |
| S-1 | 12 mg/m² |
| Matting agent (monodispersed silica particles with average size, 3.5 μm) | 25 mg/m² |
| Nucleation accelerating agent Na-3 | 30 mg/m² |
| 1,3-Vinylsulfonyl-2-propanol | 40 mg/m² |
| Surfactant h | 1 mg/m² |
| Colloidal silica (average particle size, 0.05 μm) | 20 mg/m² |
| Hardener j | 30 mg/m² |
| **Formula 4 (Backing layer)** | |
| Gelatin | 2.0 g/m² |
| S-1 | 5 mg/m² |
| Latex polymer f | 0.3 g/m² |
| Colloidal silica (average particle size, 0.05 μm) | 70 mg/m² |
| Sodium polystyrenesulfonate | 20 mg/m² |
| Compound i | 100 mg/m² |
| **Formula 8 (Backing protective layer)** | |
| Gelatin | 1.0 mg/m² |
| Matting agent (polymethyl methaacrylate monodispersed particles with av. size of 5 μm) | 50 mg/m² |
| S-1 | 10 mg/m² |
| Surfactant h | 1 mg/² |
| Dye k | 20 mg/m² |
| $H—(OCH_2CH_2)_{68}—OH$ | 50 mg/m² |
| Hardener K-1 | 20 mg/m² |

Thus prepared photographic material was evaluated in the same manner as in Example 1.

Results thereof are shown in Table 3.

As can be seen from Table 1 and 3, when a photographic light sensitive material is subjected to running-processing, in a total process time of 90 sec. using a solid developer-replenishing composition and processing method of the invention, excellent results in sensitivity, contrast and dot quality were achieved. Further, as can be seen from Table 2, when running-processed in a total process time of 45 sec., improved results in reverse text quality and contrast were achieved.

What is claimed is:

1. A solid processing composition in the form of granules or a tablet for use with water as a replenisher of a developer for processing a silver halide black-and-white photographic light sensitive material comprising a support having thereon hydrophilic colloidal layers including a silver halide emulsion layer, wherein said solid composition is substantially free from a dihydroxybenzene as a developing agent and comprises a cyclodextrin compound in an amount sufficient to produce a concentration of 0.2 to 100 g/liter in said water with which it is used as a replenisher, wherein said solid composition comprises, as a developing agent, a compound represented by the following formula in an amount sufficient to produce a concentration of 0.2 to 0.4 mole per liter in said water with which it is used as a replenisher,

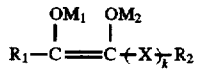

Formula (1)

wherein $R_1$ and $R_2$ independently are an alkyl group, amino group, alkoxy group or alkylthio group, provided that $R_1$ and $R_2$ may combine with each other to form a ring; k is 0 or 1, and when k is 1, X is —CO— or —CS—; $M_1$ and $M_2$ each are a hydrogen atom or alkali metal atom; and said solid composition further comprises, as a developing agent, a 3-pyrazolidone compound or p-aminophenol compound.

2. The solid processing composition of claim 1, wherein said compound is represented by the following formula (1-a),

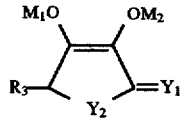

Formula (1-a)

wherein $R_3$ is a hydrogen atom, alkyl group, aryl group, alkoxy group, amino group, sulfo group, carboxy group,

TABLE 3

| Exp. No. | Replenisher | Developimg agent(g/l) | Cyclodex-trin(g/l) | Restrainer (mg/l) | Fresh S | Fresh γ | Fresh DQ | Running S | Running γ | Running DQ | Re-marks |
|---|---|---|---|---|---|---|---|---|---|---|---|
| 1 | HAD-SR(Liquid) | A-18(38) | D-5(10) | A · B*(270 · 60) | 100 | 12.0 | 5 | 78 | 9.1 | 2 | Comp. |
| 2 | HAD-JR(Liquid) | A-18(38) | — — | A · B(270 · 60) | 100 | 12.0 | 5 | 85 | 10.5 | 3 | Comp. |
| 3 | HAD-JR(Liquid) | A-18(38) | D-5(10) | A · B(270 · 60) | 100 | 12.0 | 5 | 98 | 11.5 | 4 | Inv. |
| 4 | HAD-JR(Liquid) | A-18(38) | D-5(30) | A · B(270 · 60) | 100 | 12.0 | 5 | 99 | 11.6 | 4 | Inv. |
| 5 | HAD-JR(Solid) | A-18(38) | — — | A · B(270 · 60) | 100 | 12.0 | 5 | 86 | 10.4 | 3 | Comp. |
| 6 | HAD-JR(Solid) | A-18(38) | D-5(10) | A · B(270 · 60) | 100 | 12.0 | 5 | 101 | 11.9 | 5 | Inv. |
| 7 | HAD-JR(Solid) | A-18(38) | D-5(30) | A · B(270 · 60) | 100 | 12.0 | 5 | 102 | 12.1 | 5 | Inv. |
| 8 | HAD-JR(Solid) | A-18(38) | D-14(30) | A · B(270 · 60) | 100 | 12.0 | 5 | 102 | 12.1 | 5 | Inv. |
| 9 | HAD-JR(Liquid) | A-18(38) | D-5(30) | A 270 | 100 | 12.0 | 5 | 108 | 12.1 | 5 | Inv. |
| 10 | HAD-JR(Liquid) | A-18(38) | — — | A 270 | 100 | 12.0 | 5 | 76 | 9.5 | 2 | Comp. |
| 11 | HAD-JR(Liquid) | A-18(38) | D-5(30) | — — | 100 | 12.0 | 5 | 78 | 9.7 | 2 | |

*A: 5-mercaptobenzotriazole

B: 1-phenyl-5-mercaptotetrazole amido group or sulfonamido group; $Y_1$ is O or S; $Y_2$ is O, S or $NR_4$, in which $R_4$ is an alkyl group or aryl group; $M_1$ and $M_2$ each are a hydrogen atom or alkali metal atom.

3. The solid processing composition of claim 1, wherein said dextrin compound is selected from a cyclodextrin, cyclodextrin derivative, branched cyclodextrin compound and cyclodextrin polymer.

4. The solid processing composition of claim 1, wherein at least one of the hydrophilic colloidal layers of the photographic material comprises a hydrazine compound.

5. The solid processing composition of claim 1, wherein at least one of the hydrophilic colloidal layers of the photographic material comprises a tetrazolium compound.

6. The solid processing composition of claim 1, wherein at least one of the hydrophilic colloidal layers of the photographic material comprises a pyridinium compound.

7. The solid processing composition of claim 1, wherein said silver halide emulsion layer comprises silver halide grains comprising silver bromochloride or silver iodobromochloride each containing 50 to 85 mol % chloride.

8. The solid processing composition of claim 1 wherein the compound of formula 1 is one of compounds A-1 through A-30 defined below

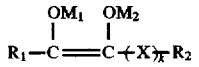

| No. | X | $R_1$ | $R_2$ | $M_1$ | $M_2$ |
|---|---|---|---|---|---|
| A-1 | – (k = 0) | $HOCH_2-CH(OH)-CH(OH)-$ | –OH | H | H |
| A-2 | – (k = 0) | $CH_3-CH(OH)-CH(OH)-$ | –OH | H | H |
| A-3 | – (k = 0) | $HOCH_2-CH(OH)-CH(OH)-$ | $-CH_3$ | H | H |
| A-4 | – (k = 0) | $CH_3-CH(OH)-CH(OH)-$ | $-CH_3$ | H | H |
| A-5 | –C(=O)– (k = 1) | $HOCH_2-CH(OH)-CH(OH)-$ | –OH | H | H |
| A-6 | –C(=O)– (k = 1) | $CH_3-CH(OH)-CH(OH)-$ | –OH | H | H |
| A-7 | –C(=S)– (k = 1) | $HOCH_2-CH(OH)-CH(OH)-$ | –OH | H | H |
| A-8 | –C(=S)– (k = 1) | $CH_3-CH(OH)-CH(OH)-$ | –OH | H | H |
| A-9 | –C(=O)– (k = 1) | $HO-CH_2-$ | –OH | Na | H |
| A-10 | –C(=O)– (k = 1) | $HO-CH_2-$ | $-CH_3$ | H | H |
| A-11 | –C(=O)– (k = 1) | $HO-CH_2-$ | $-C_2H_5$ | H | H |

-continued

| | | | | | |
|---|---|---|---|---|---|
| A-12 | –C(=O)– (k = 1) | $HO-CH_2-$ | $-C_2H_4OH$ | H | Na |

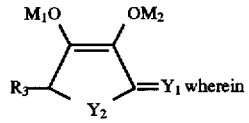

| No. | $Y_1$ | $Y_2$ | $R_3$ | $M_1$ | $M_2$ |
|---|---|---|---|---|---|
| A-13 | O | O | H | H | H |
| A-14 | O | O | $CH_3$ | H | H |
| A-15 | O | O | $CH_2(OH)$ | H | H |
| A-16 | O | O | $CH_3-CH(OH)-$ | H | H |
| A-17 | O | O | $HOCH_2-CH(OH)-$ | H | H |
| A-18 | O | O | $HOCH_2-CH(OH)-$ | Na | H |
| A-19 | O | O | $HOOCCH_2-CH(OH)-$ | H | Na |
| A-20 | S | O | H | Na | H |
| A-21 | S | O | $CH_3-CH(OH)-$ | H | H |
| A-22 | S | O | $HOCH_2-CH(OH)-$ | H | H |
| A-23 | O | $NCH_2$ | H | H | H |
| A-24 | O | NH | $HOCH_2-CH(OH)-$ | H | K |
| A-25 | O | S | H | H | H |
| A-26 | O | S | $HOCH_2-CH(OH)-$ | H | H |
| A-27 | O | S | $CH_3CH(OH)-$ | H | H |
| A-28 | S | S | H | H | H |
| A-29 | S | S | $HOCH_2-CH(OH)-$ | H | H |
| A-30 | S | S | H | H | H |

9. The solid processing composition of claim 8 wherein the 3-pyrazolidone compound or p-aminophenol compound is selected from the group consisting of 1-phenyl-3-pyrazolidone;
1-phenyl-4,4'-dimethyl-3-pyrazolidone;
1-phenyl-4-methyl-4-hydroxymethyl-3-pyrazolidone;
1-phenyl-5-methyl-3-pyrazolidone;
1-p-aminophenyl-4,4'-dimethyl-3-pyrazolidone;
1-p-tolyl-4,4'-dimethyl-3-pyrazolidone;
1-p-tolyl-4-methyl-4-hydroxymethyl-3-pyrazolidone;
N-methyl-p-aminophenol;
N-(β-hydroxyethyl)-p-aminophenol;
N-(4-hydroxyphenyl)glycine;
2-methyl-p-aminophenol; and
p-benzylaminophenol.

* * * * *